US006984027B2

(12) United States Patent
Sakaida et al.

(10) Patent No.: US 6,984,027 B2
(45) Date of Patent: Jan. 10, 2006

(54) INK-JET HEAD AND INK-JET PRINTER HAVING INK-JET HEAD

(75) Inventors: Atsuo Sakaida, Gifu (JP); Hidetoshi Watanabe, Tokoname (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/367,693

(22) Filed: Feb. 19, 2003

(65) Prior Publication Data

US 2003/0156164 A1 Aug. 21, 2003

Related U.S. Application Data

(63) Continuation-in-part of application No. 10/305,979, filed on Nov. 29, 2002.

(30) Foreign Application Priority Data

Nov. 30, 2001 (JP) ..... 2001-365497
Feb. 18, 2002 (JP) ..... 2002-040524
Feb. 21, 2002 (JP) ..... 2002-045110

(51) Int. Cl.
*B41J 2/045* (2006.01)

(52) U.S. Cl. ..... 347/68

(58) Field of Classification Search ..... 347/68, 347/70–72, 20, 54–56
See application file for complete search history.

(56) References Cited

U.S. PATENT DOCUMENTS

| | | | |
|---|---|---|---|
| 4,680,595 | A | 7/1987 | Cruz-Uribe et al. |
| 5,087,930 | A | 2/1992 | Roy et al. |
| 5,402,159 | A | 3/1995 | Takahashi et al. |
| 5,406,318 | A | 4/1995 | Moore et al. |
| 5,592,203 | A | 1/1997 | Thiel et al. |
| 5,752,303 | A | 5/1998 | Thiel |
| 5,757,400 | A | 5/1998 | Hoisington |

FOREIGN PATENT DOCUMENTS

| | | | |
|---|---|---|---|
| EP | 1 138 493 A1 | | 10/2001 |
| JP | 63-280649 | | 11/1988 |
| JP | 4-341852 | | 11/1992 |
| JP | 06-143559 | * | 5/1994 |
| JP | 7-67803 | | 7/1995 |
| JP | 7-246701 | | 9/1995 |
| JP | 8-25628 | | 1/1996 |

* cited by examiner

*Primary Examiner*—Stephen Meier
*Assistant Examiner*—An H. Do
(74) *Attorney, Agent, or Firm*—Oliff & Berridge, PLC

(57) ABSTRACT

An ink-jet head includes a passage unit including a plurality of pressure chambers each connected with a nozzle and arranged in a matrix in a plane to form a plurality of pressure chamber rows in a first direction in the plane, and a plurality of common ink passages each extending along the first direction and communicating with the pressure chambers.

18 Claims, 12 Drawing Sheets

INK-JET HEAD AND INK-JET PRINTER HAVING INK-JET HEAD

CROSS-REFERENCE TO RELATED APPLICATION

This application is a Continuation-in-Part of Application No. 10/305,979 filed on Nov. 29, 2002, the disclosure of which is incorporated herein in its entirety by reference.

BACKGROUND OF THE INVENTION

1. Field of Invention

The invention relates to an ink-jet head for printing by ejecting ink onto a record medium, and to an ink-jet printer having the ink-jet head.

2. Description of Related Art

In an ink-jet printer, an ink-jet head distributes ink, which is supplied from an ink tank, to pulse pressure chambers. The ink-jet head selectively applies pressure to each pressure chamber to eject ink through a nozzle connected with each pressure chamber. As a means for selectively applying pulse pressure to the pressure chambers, an actuator unit or the like may be used in which ceramic piezoelectric sheets are laminated. The printing operations are carried out while reciprocating such a head at a high speed in the widthwise direction of the paper.

As for an arrangement of the pressure chambers in such an ink-jet head, there is a one-dimensional arrangement in which pressure chambers are arranged in, e.g., one or two rows along the length of the head, and a two-dimensional arrangement in which pressure chambers are arranged in a matrix along a surface of the head. To achieve high-resolution and high-speed printing, the two-dimensional arrangement of the pressure chambers is more effective. As an example of an ink-jet head in which the pressure chambers are arranged in a matrix along a surface of the head, an ink-jet head is known in which a nozzle is disposed at the center of each pressure chamber in a view perpendicular to the head surface. In this case, when pulse pressure is applied to a pressure chamber, a pressure wave propagates in the pressure chamber perpendicularly to the head surface. Ink is then ejected through the corresponding nozzle disposed at the center of the pressure chamber in a view perpendicular to the head surface.

In the above-described construction in which a nozzle is disposed at the center of each pressure chamber in a view perpendicular to the head surface, the width of a common ink passage for supplying ink may be restricted by each interval of nozzles corresponding to neighboring pressure chambers. This occurs because the common ink passage must be disposed so as not to overlap the nozzle at the center of each pressure chamber in a view perpendicular to the head surface. Besides, in this case, if nozzles are arranged at a high density to meet the demands of high-resolution and high-speed printing, the arrangement may restrict the width of the common ink passage. If the width of the common ink passage is thus restricted, the passage resistance of the common ink passage to ink is high. Thus, the smoothness of the ink supply corresponding to the maximum ink ejection cycle can not be intended.

SUMMARY OF THE INVENTION

The invention thus provides an ink-jet head which maintains the smoothness of the ink supply and provides an ink-jet printer having the ink-jet head.

According to a first exemplary aspect of the invention, the invention provides for an ink-jet head including a passage unit including a plurality of pressure chambers each connected with a nozzle and arranged in a matrix in a plane to form a plurality of pressure chamber rows in a first direction in the plane, and a plurality of common ink passages each extending along the first direction and communicating with the pressure chambers. The pressure chamber rows include first pressure chamber rows each constituted by pressure chambers each connected with a nozzle deviated on one side thereof with respect to a second direction crossing the first direction, and second pressure chamber rows each constituted by pressure chambers each connected with a nozzle deviated on another side thereof with respect to the second direction, when viewing from a third direction perpendicular to the plane. Each of the common ink passages includes at least a boundary region between one of the first pressure chamber rows and one of the second pressure chamber rows neighboring each other so that the nozzles connected with the pressure chambers in each of the pressure chamber rows face outward each other when viewing from the third direction. Each of the common ink passages does not overlap any of the nozzles.

According to a second exemplary aspect of the invention, there is provided an ink-jet printer including an ink-jet head. The ink-jet head includes a passage unit including a plurality of pressure chambers each connected with a nozzle and arranged in a matrix in a plane to form a plurality of pressure chamber rows in a first direction in the plane, and a plurality of common ink passages each extending along the first direction and communicating with the pressure chambers. The pressure chamber rows include first pressure chamber rows each constituted by pressure chambers each connected with a nozzle deviated on one side thereof with respect to a second direction crossing the first direction, and second pressure chamber rows each constituted by pressure chambers each connected with a nozzle deviated on another side thereof with respect to the second direction, when viewing from a third direction perpendicular to the plane. Each of the common ink passages includes at least a boundary region between one of the first pressure chamber rows and one of the second pressure chamber rows neighboring each other so that nozzles connected with the pressure chambers in the each pressure chamber rows face outward each other when viewing from the third direction. Each of the common ink passages does not overlap any of the nozzles.

In this construction, since each nozzle is not disposed at the center of the corresponding pressure chamber but deviated to one side of the pressure chamber, when viewed from the third direction perpendicular to the surface, and each common ink passage is disposed so as to include the boundary region between the first and second pressure chamber rows in which nozzles are deviated to opposite sides to each other with respect to the first direction, the width of each common ink passage can be made large. Therefore, even when the thickness (depth) of each common ink passage in the above third direction is fixed, the passage resistance of the common ink passage to ink is low and smooth ink supply to each pressure chamber can be performed.

BRIEF DESCRIPTION OF THE DRAWINGS

Other and further objects, features and advantages of the invention will appear more fully from the following description taken in connection with the accompanying drawings in which.

DETAILED DESCRIPTION OF PREFERRED EMBODIMENTS

Figure 1:
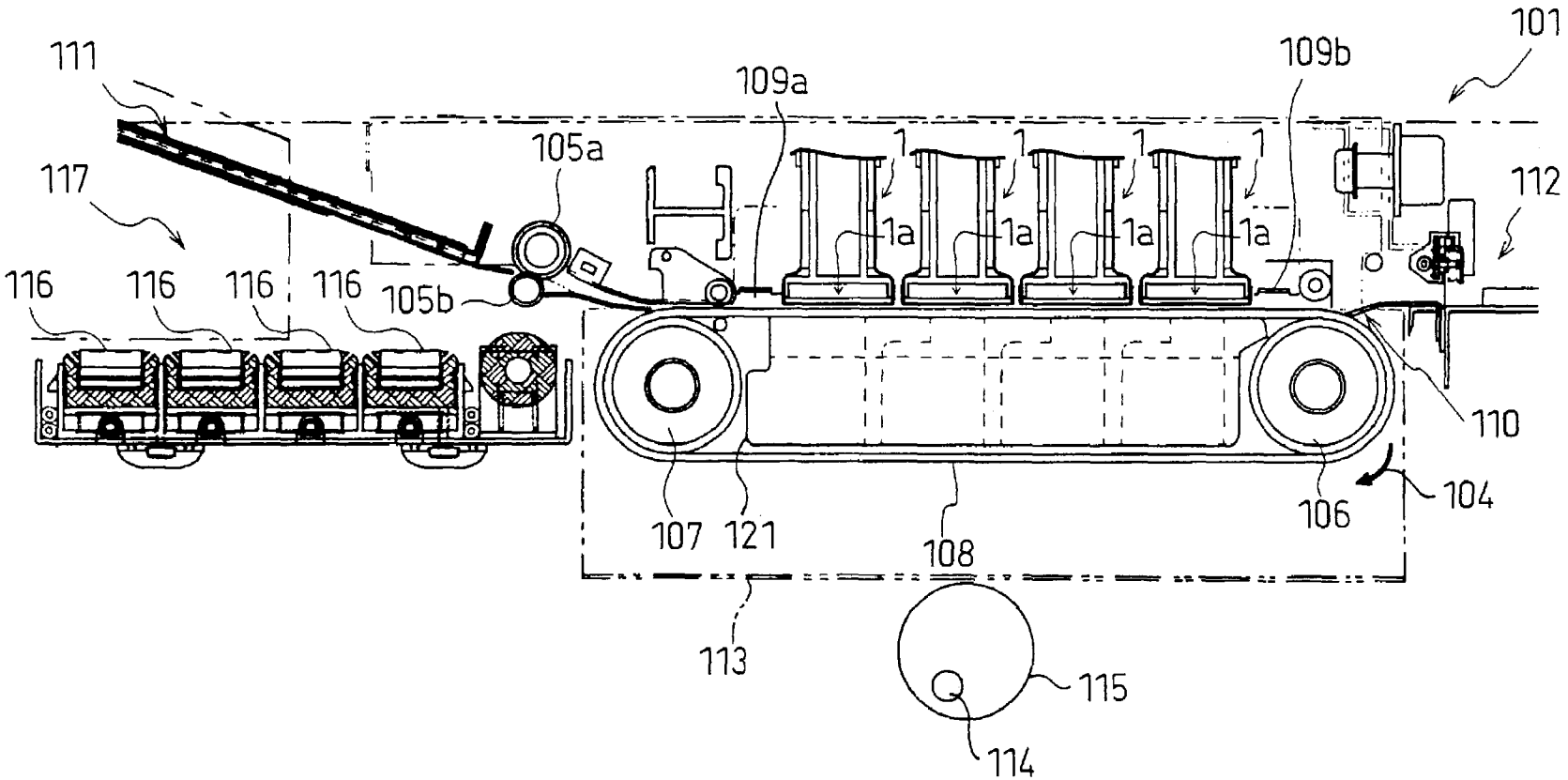
FIG. 1 is a general view of an ink-jet printer including ink-jet heads according to an embodiment of the invention.

FIG. 1 is a general view of an ink-jet printer including ink-jet heads according to an embodiment of the invention. The ink-jet printer 101, as illustrated in FIG. 1, is a color ink-jet printer having four ink-jet heads 1. In this printer 101, a paper feed unit 111 and a paper discharge unit 112 are disposed in left and right portions of FIG. 1, respectively.

In the printer 101, a paper transfer path is provided extending from the paper feed unit 111 to the paper discharge unit 112. A pair of feed rollers 105*a* and 105*b* is disposed immediately downstream of the paper feed unit 111 for pinching and putting forward a paper as an image record medium. By the pair of feed rollers 105*a* and 105*b*, the paper is transferred from the left to the right in FIG. 1. In the middle of the paper transfer path, two belt rollers 106 and 107 and an endless transfer belt 108 are disposed. The transfer belt 108 is wound on the belt rollers 106 and 107 to extend between them. The outer face, i.e., the transfer face, of the transfer belt 108 has been treated with silicone. Thus, a paper fed through the pair of feed rollers 105*a* and 105*b* can be held on the transfer face of the transfer belt 108 by the adhesion of the face. In this state, the paper is transferred downstream (rightward) by driving one belt roller 106 to rotate clockwise in FIG. 1 (the direction indicated by an arrow 104).

Pressing members 109*a* and 109*b* are disposed at positions for feeding a paper onto the belt roller 106 and taking out the paper from the belt roller 106, respectively. Either of the pressing members 109*a* and 109*b* is for pressing the paper onto the transfer face of the transfer belt 108 so as to prevent the paper from separating from the transfer face of the transfer belt 108. Thus, the paper surely adheres to the transfer face.

A peeling device 110 is provided immediately downstream of the transfer belt 108 along the paper transfer path. The peeling device 110 peels off the paper, which has adhered to the transfer face of the transfer belt 108, in order to transfer the paper toward the rightward paper discharge unit 112.

Each of the four ink-jet heads 1 has, at its lower end, a head main body 1*a*. Each head main body 1*a* has a rectangular section. The head main bodies 1*a* are arranged close to each other with the longitudinal axis of each head main body 1*a* being perpendicular to the paper transfer direction (perpendicular to FIG. 1). That is, this printer 101 is a line type. The bottom of each of the four head main bodies 1*a* faces the paper transfer path. In the bottom of each head main body 1*a*, a number of nozzles are provided each having a small-diameter ink ejection port. The four head main bodies 1*a* eject ink of magenta, yellow, cyan, and black, respectively.

The head main bodies 1*a* are disposed such that a narrow clearance must be formed between the lower face of each head main body 1*a* and the transfer face of the transfer belt 108. The paper transfer path is formed within the clearance. In this construction, while a paper, which is being transferred by the transfer belt 108, passes immediately below the four head main bodies 1*a* in order, the respective color inks are ejected through the corresponding nozzles toward the upper face, i.e., the print face, of the paper to form a desired color image on the paper.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a not-illustrated purge system.

The maintenance unit 117 is at a position immediately below the paper feed unit 111 (withdrawal position) while the ink-jet printer 101 is printing. When a predetermined condition is satisfied after finishing the printing operation (for example, when a state in which no printing operation is performed continues for a predetermined time period or when the printer 101 is powered off), the maintenance unit 117 moves to a position immediately below the four head main bodies 1*a* (cap position), where the maintenance unit 117 covers the lower faces of the head main bodies 1*a* with the respective caps 116 to prevent ink in the nozzles of the head main bodies 1*a* from being dried.

The belt rollers 106 and 107 and the transfer belt 108 are supported by a chassis 113. The chassis 113 is put on a cylindrical member 115 disposed under the chassis 113. The cylindrical member 115 is rotatable around a shaft 114 provided at a position deviating from the center of the cylindrical member 115. Thus, by rotating the shaft 114, the level of the uppermost portion of the cylindrical member 115 can be changed to move up or down the chassis 113 accordingly. When the maintenance unit 117 is moved from the withdrawal position to the cap position, the cylindrical member 115 must be rotated at a predetermined angle in advance so as to move down the transfer belt 108 and the belt rollers 106 and 107 by a pertinent distance from the position illustrated in FIG. 1. A space for the movement of the maintenance unit 117 is thereby ensured.

In the region surrounded by the transfer belt 108, a nearly rectangular parallelepiped guide 121 (having its width substantially equal to that of the transfer belt 108) is disposed at an opposite position to the ink-jet heads 1. The guide 121 is in contact with the lower face of the upper part of the transfer belt 108 to support the upper part of the transfer belt 108 from the inside.

Figure 2:
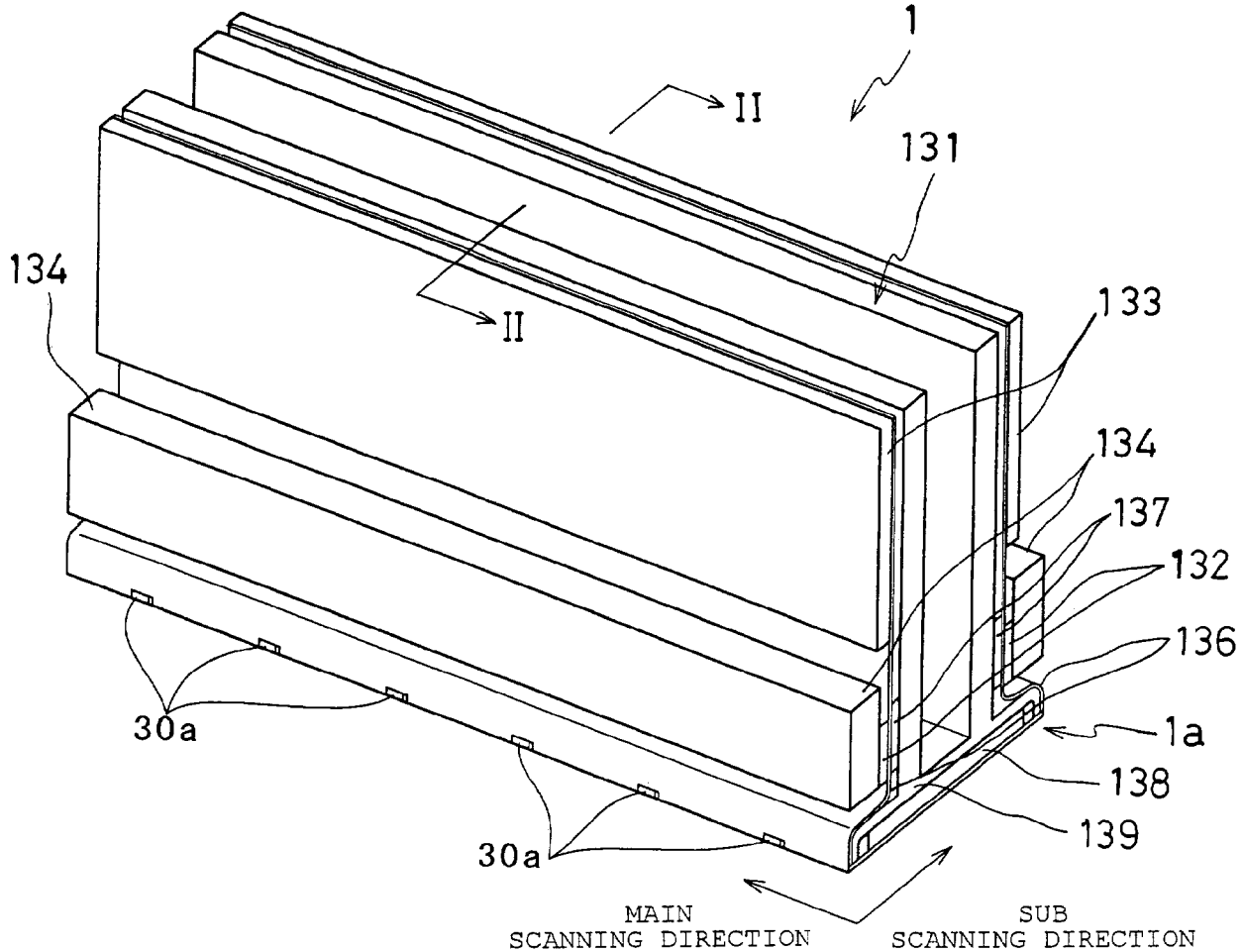
FIG. 2 is a perspective view of an ink-jet head according to the embodiment of the invention.
Figure 3:
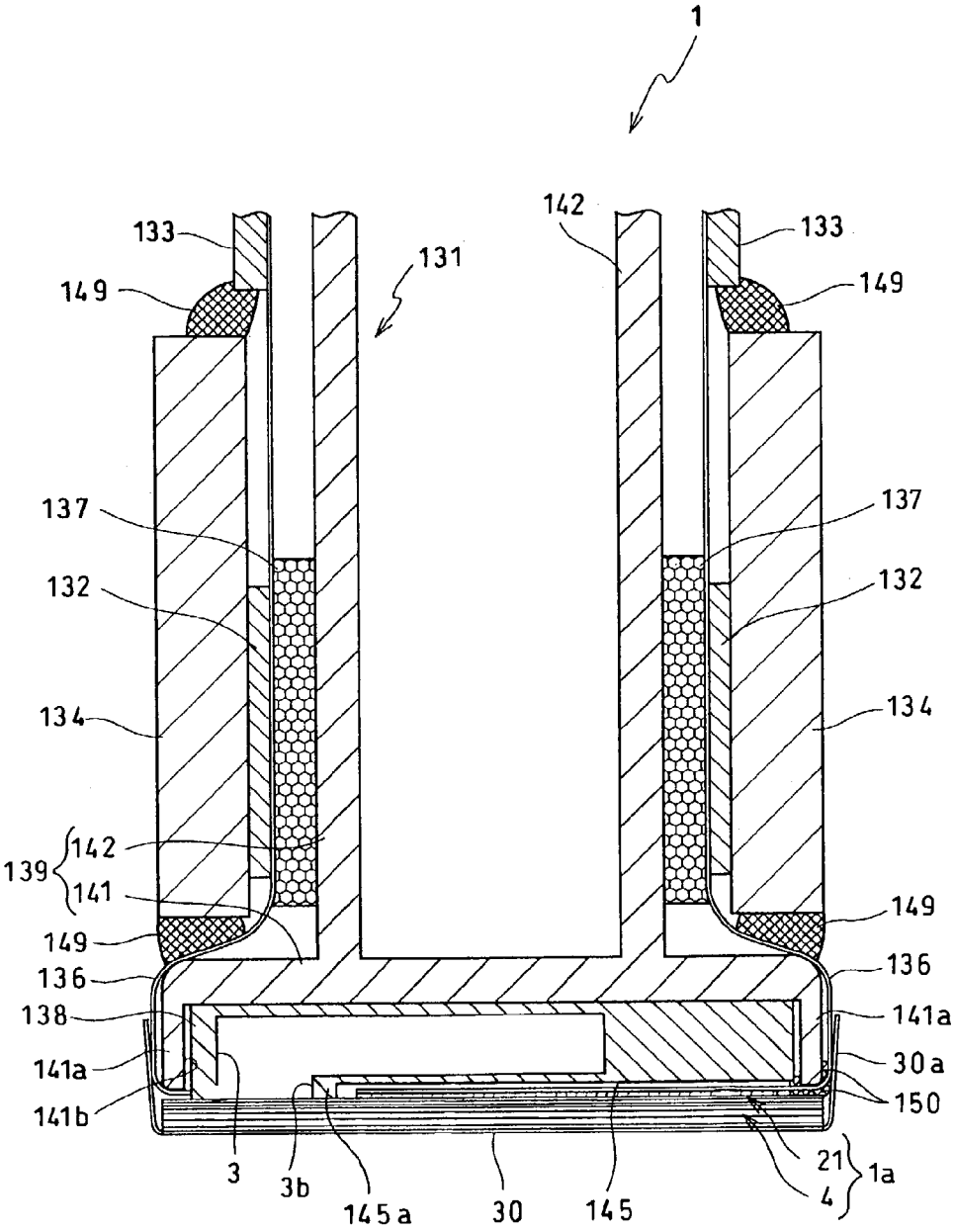
FIG. 3 is a sectional view taken along line II—II in FIG. 2.

Next, the construction of each ink-jet head 1 according to this embodiment will be described in more detail. FIG. 2 is a perspective view of the ink-jet head 1. FIG. 3 is a sectional view taken along line II—II in FIG. 2. Referring to FIGS. 2 and 3, the ink-jet head 1 according to this embodiment includes a head main body 1*a* having a rectangular shape in a plan view and extending in one direction (main scanning direction), and a base portion 131 for supporting the head main body 1*a*. The base portion 131 supporting the head main body 1*a* further supports thereon driver ICs 132 for supplying driving signals to individual electrodes 35*a* and 35*b* (see FIG. 6 and FIG. 10), and substrates 133.

Referring to FIG. 2, the base portion 131 is made up of a base block 138 partially bonded to the upper face of the head main body 1*a* to support the head main body 1*a*, and a holder 139 bonded to the upper face of the base block 138 to support the base block 138. The base block 138 is a nearly rectangular parallelepiped member having substantially the same length of the head main body 1*a*. The base block 138 is made of metal material such as stainless steel and functions as a light structure for reinforcing the holder 139. The holder 139 is made up of a holder main body 141 disposed near the head main body 1*a*, and a pair of holder support portions 142 each extending on the opposite side of the holder main body 141 to the head main body 1*a*. Each holder support portion 142 is as a flat member. These holder support portions 142 extend along the longitudinal direction of the holder main body 141 and are disposed in parallel with each other at a predetermined interval.

Skirt portions 141*a* in a pair, protruding downward, are provided in both end portions of the holder main body 141*a* in a sub scanning direction (perpendicular to the main scanning direction). Either skirt portion 141*a* is formed through the length of the holder main body 141. As a result, in the lower portion of the holder main body 141, a nearly rectangular parallelepiped groove 141*b* is defined by the pair of skirt portions 141*a*. The base block 138 is received in the groove 141*b*. The upper surface of the base block 138 is bonded to the bottom of the groove 141*b* of the holder main body 141 with an adhesive. The thickness of the base block 138 is somewhat larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular parallelepiped space (hollow region) extending along the longitudinal direction of the base block 138. In the lower face 145 of the base block 138, openings 3*b* (see FIG. 4) are formed each communicating with the ink reservoir 3. The ink reservoir 3 is connected through a not-illustrated supply tube with a not-illustrated main ink tank (ink supply source) within the printer main body. Thus, the ink reservoir 3 is suitably supplied with ink from the main ink tank.

In the lower face 145 of the base block 138, the vicinity of each opening 3*b* protrudes downward from the surrounding portion. The base block 138 is in contact with a passage unit 4 (see FIG. 3) of the head main body 1*a* at the vicinity portion 145*a* of each opening 3*b* of the lower face 145. Thus, the region of the lower face 145 of the base block 138, other than the vicinity portion 145*a* of each opening 3*b*, is distant from the head main body 1*a*. Actuator units 21 are disposed within the distance.

To the outer side face of each holder support portion 142 of the holder 139, a driver IC 132 is fixed with an elastic member 137 such as a sponge being interposed between them. A heat sink 134 is disposed in close contact with the outer side face of the driver IC 132. The heat sink 134 is made of a nearly rectangular parallelepiped member for efficiently radiating heat generated in the driver IC 132. A flexible printed circuit (FPC) 136 as a power supply member is connected with the driver IC 132. The FPC 136 connected with the driver IC 132 is bonded to and electrically connected with the corresponding substrate 133 and the head main body la by soldering. The substrate 133 is disposed outside the FPC 136 above the driver IC 132 and the heat sink 134. The upper face of the heat sink 134 is bonded to the substrate 133 with a seal member 149. Also, the lower face of the heat sink 134 is bonded to the FPC 136 with a seal member 149.

Between the lower face of each skirt portion 141*a* of the holder main body 141 and the upper face of the passage unit 4, a seal member 150 is disposed to sandwich the FPC 136. The FPC 136 is fixed by the seal member 150 to the passage unit 4 and the holder main body 141. Therefore, even if the head main body 1*a* is elongated, the head main body 1*a* can be prevented from being bent, the interconnecting portion between each actuator unit and the FPC 136 can be prevented from receiving stress, and the FPC 136 can surely be held.

Referring to FIG. 2, in the vicinity of each lower corner of the ink-jet head 1 along the main scanning direction, six protruding portions 30*a* are disposed at regular intervals along the corresponding side wall of the ink-jet head 1. These protruding portions 30*a* are provided at both ends in the sub scanning direction of a nozzle plate 30 in the lowermost layer of the head main body 1*a* (see FIG. 7). The nozzle plate 30 is bent by about 90 degrees along the boundary line between each protruding portion 30*a* and the other portion. The protruding portions 30*a* are provided at positions corresponding to the vicinities of both ends of various papers to be used for printing. Each bent portion of the nozzle plate 30 has a shape not right-angled but rounded. This makes it hard to bring about clogging of a paper, i.e., jamming, which may occur because the leading edge of the paper, which has been transferred to approach the head 1, is stopped by the side face of the head 1.

Figure 4:
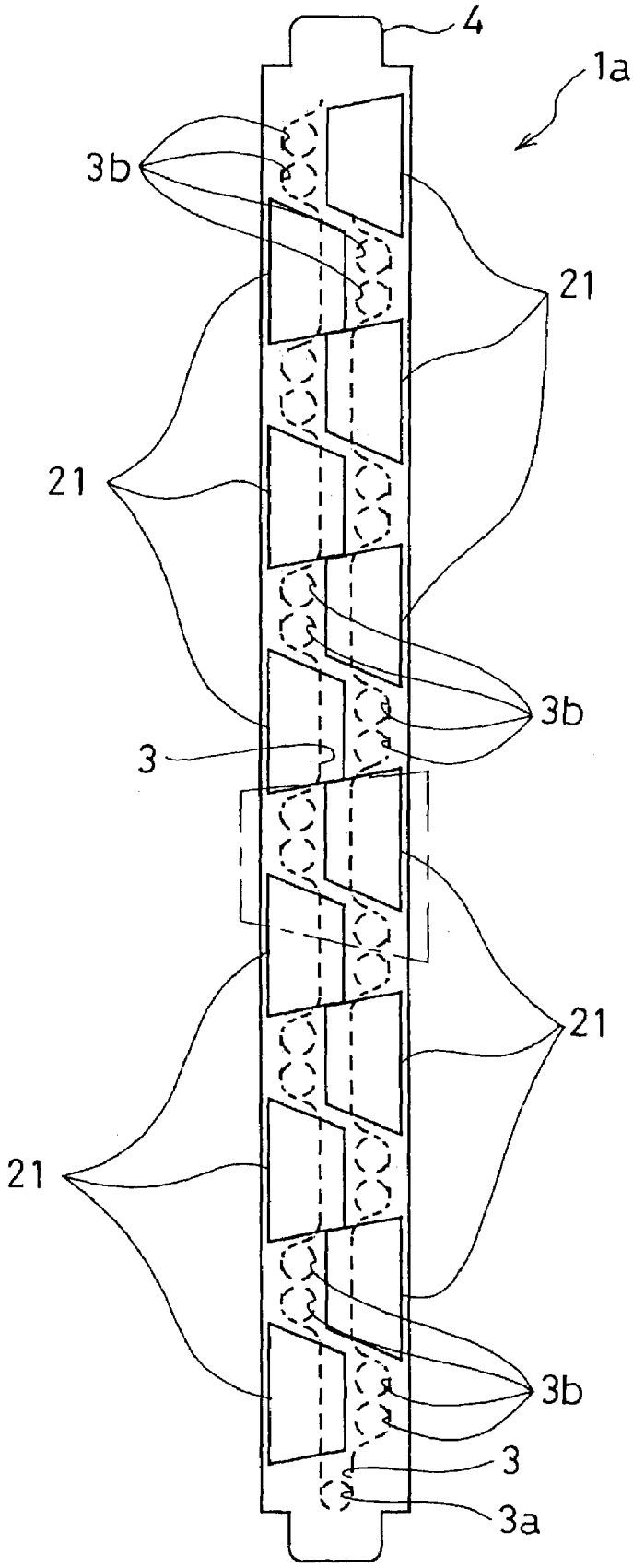
FIG. 4 is a plan view of a head main body included in the ink-jet head of FIG. 2.

FIG. 4 is a schematic plan view of the head main body 1*a*. In FIG. 4, an ink reservoir 3 formed in the base block 138 is imaginarily illustrated with a broken line. Referring to FIG. 4, the head main body 1*a* has a rectangular shape in the plan view extending in one direction (main scanning direction). The head main body 1*a* includes a passage unit 4 in which a large number of pressure chambers 10 and a large number of ink ejection ports 8 and located at the front ends of the nozzles (as for both, see FIGS. 5, 6, and 7), as described later. Trapezoidal actuator units 21 arranged in two lines in a staggered shape are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 21 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not illustrated) through an opening 3*a* provided at one end of the ink reservoir 3, so that the ink reservoir 3 is always filled up with ink. In the ink reservoir 3, pairs of openings 3*b* are provided in regions where no actuator unit 21 is present, so as to be arranged in a staggered shape along the longitudinal direction of the ink reservoir 3.

Figure 5:
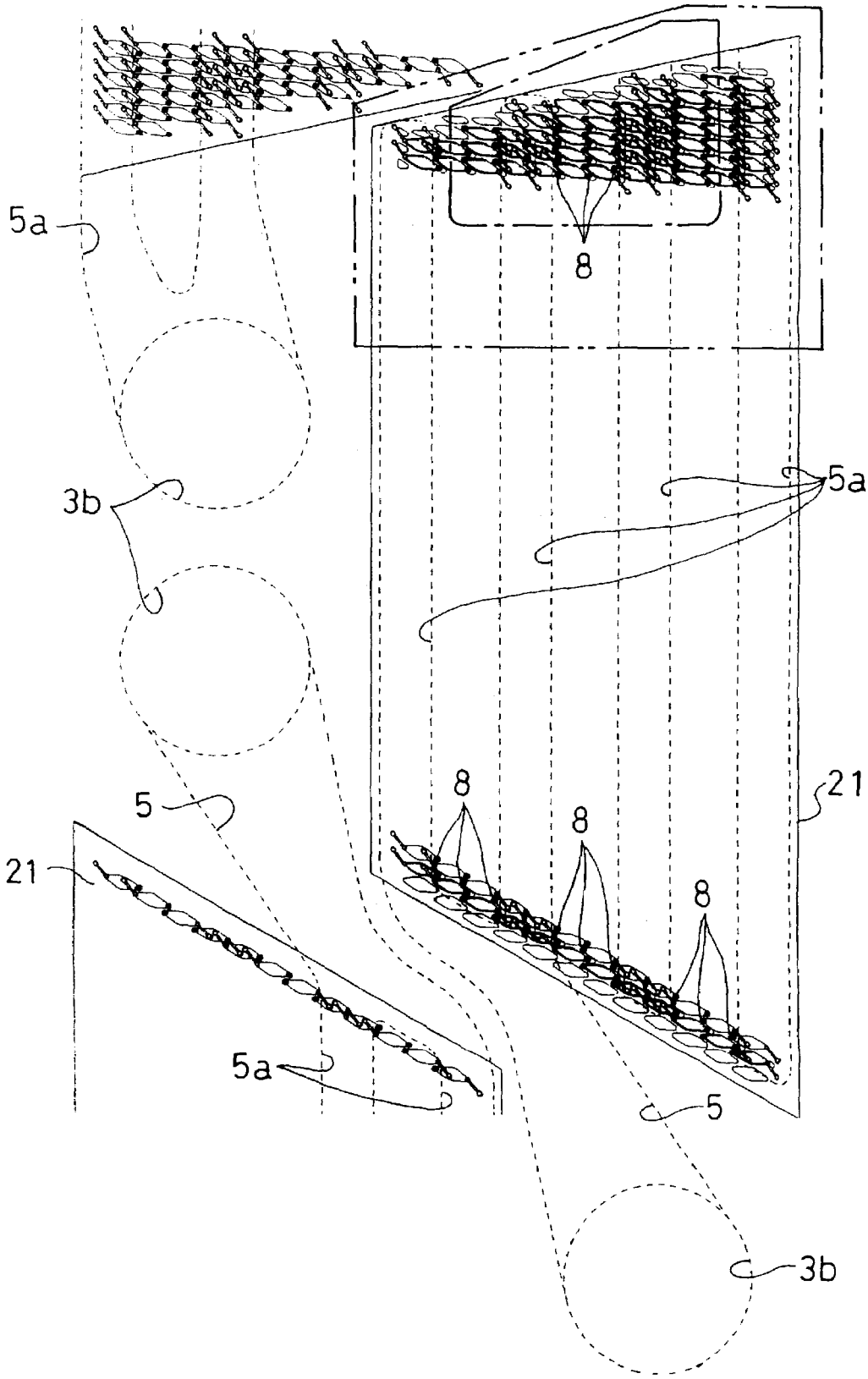
FIG. 5 is an enlarged view of the region enclosed with an alternate long and short dash line in FIG. 4.

FIG. 5 is an enlarged view of the region enclosed with an alternate long and short dash line in FIG. 4. Referring to FIGS. 4 and 5, the ink reservoir 3 communicates through each opening 3*b* with a manifold channel 5 disposed under the opening 3*b*. Each opening 3*b* is provided with a filter (not illustrated) for catching dust and dirt contained in ink. The front end portion of each manifold channel 5 branches into two sub-manifold channels 5*a*. Below a single one of the actuator unit 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* functions as a common ink passage and it is filled up with ink supplied from the ink reservoir 3.

Figure 6:
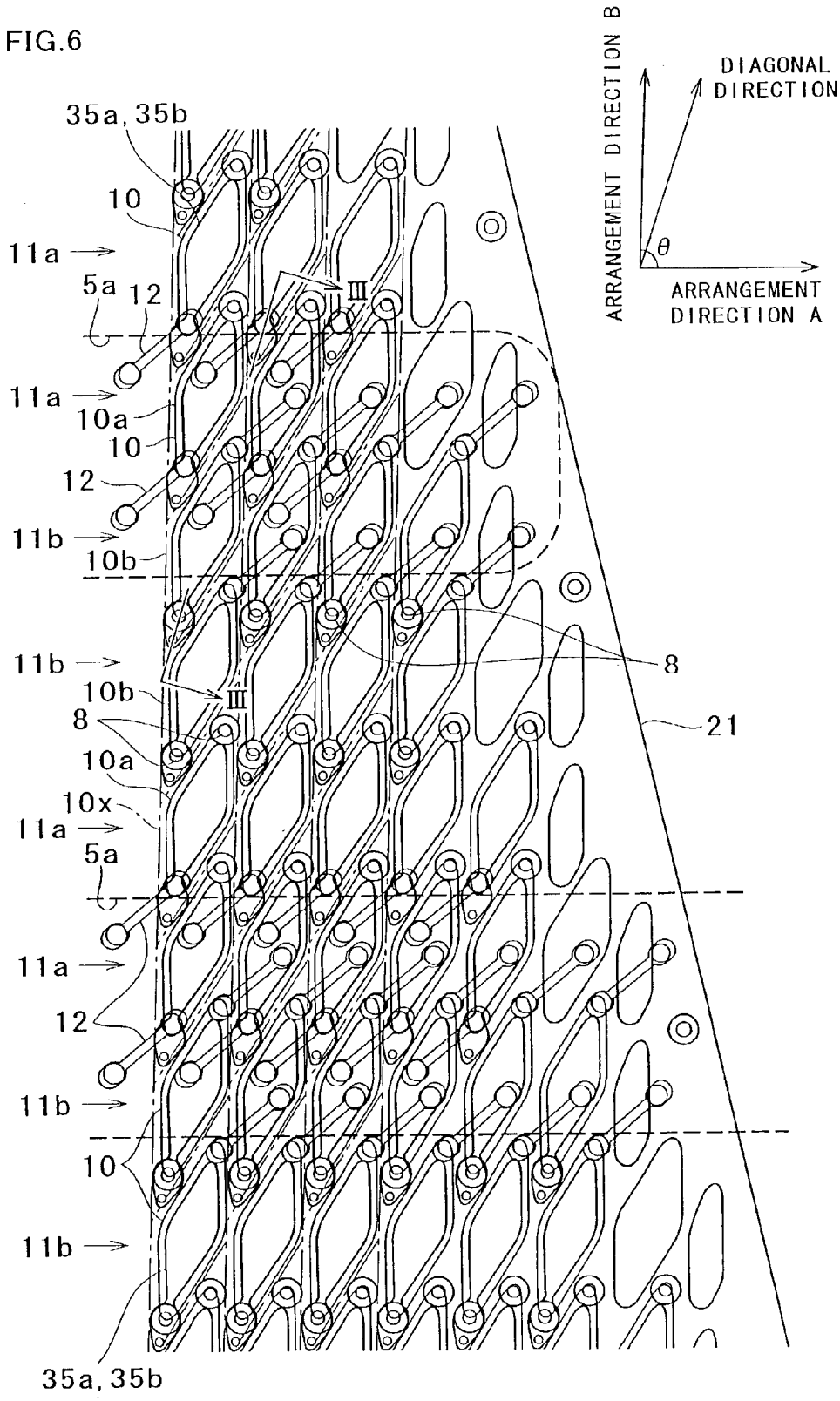
FIG. 6 is an enlarged view of the region enclosed with an alternate long and short dash line in FIG. 5.

FIG. 6 is an enlarged view of the region enclosed with an alternate long and short dash line in FIG. 5. Either of FIGS. 5 and 6 is a vertical view of a plane in which many pressure chambers 10 are arranged in a matrix in the passage unit 4. Pressure chambers 10, apertures 12, ink ejection port 8, sub-manifold channels, etc., as components of the passage unit 4, are disposed at different levels from one another perpendicularly to FIGS. 5 and 6 (see FIG. 7).

Figure 7:
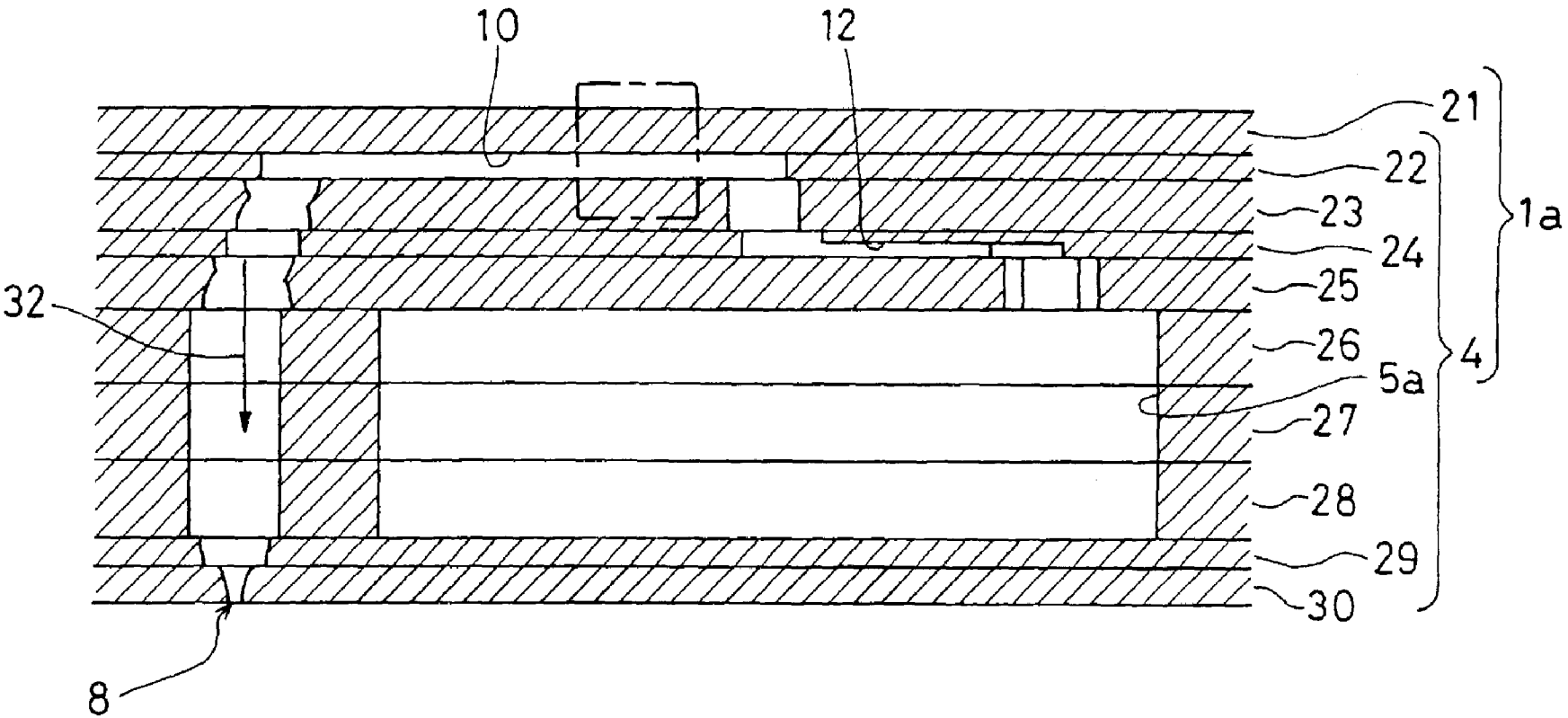
FIG. 7 is a partial sectional view of the head main body of FIG. 4 taken along line III—III in FIG. 6.

The pressure chambers 10 are connected with nozzles (FIGS. 5 and 6 illustrates ink ejection ports 8 formed at the tip ends of the respective nozzles), respectively. The pressure chambers 10 are arranged along the surface of each trapezoidal ink ejection region illustrated in FIG. 5, in a matrix in two directions, i.e., an arrangement direction A (arrangement direction A) and an arrangement direction B (along a vertical oblique side of a parallelogrammic region 10× illustrated in FIG. 6). Each pressure chamber 10 has a nearly parallelogrammic shape (length: 900 μm, width: 350 μm) in a plan view whose corners are rounded. Each pressure chamber 10 is included within the corresponding one of parallelogrammic regions 10× arranged in a matrix. The parallelogrammic regions 10× are arranged in a matrix with pressure chambers 10 neighboring each other without overlapping each other so that each parallelogrammic region 10× may have its sides in common with those of other parallelogrammic regions 10×. The pressure chamber 10 in each parallelogrammic region 10× is also disposed as to have its center coinciding with the center of the parallelogrammic region 10×. As a result, the pressure chambers 10 are separated from one another. As illustrated in FIG. 7, one end of each pressure chamber 10 is connected with a nozzle and the other end is connected with a sub-manifold channel 5*a* as a common ink passage.

FIG. 6 illustrates pairs of individual electrodes 35*a* and 35*b* each overlapping the corresponding pressure chamber 10 in a plan view and having a shape in a plan view similar to that of the pressure chamber 10 and somewhat smaller than the pressure chamber 10.

The pressure chambers 10 arranged in a matrix constitute pressure chamber rows along the arrangement direction A (first direction) in FIG. 6. When viewing perpendicularly to FIG. 6 (third direction), the pressure chamber rows are classified into first and second pressure chamber rows 11*a* and 11*b* in accordance with the disposition of the nozzle connected with each pressure chamber 10. As for the pressure chambers 10 constituting each first pressure chamber row 11*a*, when viewing perpendicularly to FIG. 6 (third direction), the nozzles connected with the pressure chambers 10 and the ink ejection ports 8 formed at the tip ends of the respective nozzles are deviated upward in FIG. 6, with respect to the longer diagonal of each parallelogrammic region 10× (second direction) crossing the arrangement direction A. That is, as illustrated in FIG. 6, in each pressure chamber 10 constituting each first pressure chamber row 11*a* in this embodiment, the ink ejection port 8 is disposed at the upper end of the corresponding parallelogrammic region 10×. On the other hand, as for the pressure chambers 10 constituting each second pressure chamber row 11*b*, the nozzles connected with the pressure chambers 10 and the ink ejection ports 8 formed at the tip ends of the respective nozzles are deviated downward in FIG. 6, with respect to the second direction. That is, as illustrated in FIG. 6, in each pressure chamber 10 constituting each second pressure chamber row 11*b* in this embodiment, the ink ejection port 8 is disposed at the lower end of the corresponding parallelogrammic region 10×. Two first pressure chamber rows 11*a* and two second pressure chamber rows 11*b* are alternately arranged. The arrangement direction A (first direction) in FIG. 6 is along the length of the ink-jet head 1 and the arrangement direction B is along an oblique side of each parallelogrammic region 10× somewhat oblique to the width of the ink-jet head 1.

Each sub-manifold channel 5*a*, which functions as a common ink passage, extends in the arrangement direction A and communicates with pressure chambers 10 disposed on both sides of the sub-manifold channel 5*a*. When viewing perpendicularly to FIG. 6 (third direction), each sub-manifold channel 5*a* extends to include first and second pressure chamber rows 11*a* and 11*b* neighboring each other so that the nozzles and the ink ejection ports 8 at the tip ends of the respective nozzles may face outward of the sub-manifold channel 5*a*. The sub-manifold channel 5*a* does not overlap the nozzles and the ink ejection ports 8 at the tip ends of the respective nozzles. In order to increase the width of each sub-manifold channel 5*a*, each sub-manifold channel 5*a* preferably includes the most parts of the neighboring first and second pressure chamber rows 11*a* and 11*b* as long as the sub-manifold channel 5*a* does not overlap the nozzles and the ink ejection ports 8. That is, to smoothly supply ink to each pressure chamber 10 communicating with the sub-manifold channel 5*a*, the limit of the width of the sub-manifold channel 5*a* is preferably set near the one end of each pressure chamber 10 connected with the ink ejection port 8. By this, even when the thickness of each sub-manifold channel 5*a* in the above third direction (depth) is fixed, the passage resistance of the sub-manifold channel 5*a* to ink can be reduced.

FIG. 7 is a partial sectional view of the head main body 1*a* of FIG. 4. As apparent from FIG. 7, each ink ejection port 8 is formed at the tip end of a tapered nozzle. Between a pressure chamber 10 and a sub-manifold channel 5*a*, an aperture 12 extends substantially in parallel with the surface of the passage unit 4, like the pressure chamber 10. This aperture 12 is for restricting the ink flow to give the passage a suitable resistance, thereby intending the stabilization of ink ejection. Each ink ejection port 8 communicates with a sub-manifold channel 5*a* through a pressure chamber 10 (length: 900 μm, width: 350 μm) and an aperture 12. Thus, within the ink-jet head 1 formed are ink passages 32 each extending from an ink tank to an ink ejection port 8 through an ink reservoir 3, a manifold channel 5, a sub-manifold channel 5*a*, an aperture 12, and a pressure chamber 10.

For example, when the pressure chamber 10 of FIG. 7 constitutes a first pressure chamber row 11*a* of FIG. 6, a nozzle connected with a pressure chamber 10 constituting a second pressure chamber row 11*b* is disposed on the right side of the sub-manifold channel 5*a* in FIG. 7.

When viewing perpendicularly to FIG. 6 (third direction), the aperture 12 communicating with a pressure chamber 10 is disposed so as to overlap another pressure chamber 10 neighboring that pressure chamber 10. A cause making this arrangement possible is that the aperture 12 is disposed on the sub-manifold channel 5*a* side of the pressure chamber 10 with respect to a direction perpendicular to FIG. 6 (third direction) and it is provided at the different level from the pressure chamber 10. Referring to FIG. 7, each of the pressure chamber 10, the aperture 12, and the sub-manifold channel 5*a* is formed within layered sheet members. When viewing from the above third direction, they are disposed so as to overlap one another.

In FIGS. 5 and 6, to make it easy to understand the drawings, the pressure chambers 10, the apertures 12, etc., are illustrated with solid lines though they should be illustrated with broken lines because they are below the actuator unit 21.

When the actuator unit 21 applies a pulse pressure to a pressure chamber and a pressure wave is thereby generated, the pressure wave which contributes to the ink ejection propagates in the pressure chamber 10 along the longer diagonal of the corresponding parallelogrammic region 10× (second direction). When the pressure wave propagation direction is perpendicular to the surface, the pressure chamber 10 is generally made into a shape in a plan view symmetrical with respect to the origin, such as a circle or a regular polygon. However, as in this embodiment, when the pressure wave propagating in the pressure chamber 10 in a specific direction along the surface of the passage unit 4 is utilized for ink ejection, the pressure chamber 10 is preferably made into a shape, in a plan view, slender in the pressure wave propagation direction because the ink ejection amount and ejection period are made easy to control by increasing the propagation time length of the pressure wave (Al: Acoustic Length).

In the plane of FIGS. 5 and 6, pressure chambers 10 are arranged within an ink ejection region in two directions, i.e., a direction along the length of the ink-jet head 1 (arrangement direction A) and a direction somewhat inclining from the width of the ink-jet head 1 (arrangement direction B). The arrangement directions A and B form an angle 'theta' somewhat smaller than the right angle. The ink ejection ports 8 are arranged at 50 dpi in the arrangement direction A. On the other hand, the pressure chambers 10 are arranged in the arrangement direction B such that the ink ejection region corresponding to one actuator unit 21 may include twelve pressure chambers 10. The shift to the arrangement direction A due to the arrangement in which twelve pressure chambers 10 are arranged in the arrangement direction B, corresponds to one pressure chamber 10. Therefore, within the whole width of the ink-jet head 1, in a region of the interval between two ink ejection ports 8 neighboring each other in the arrangement direction A, there are twelve ink ejection ports 8. At both ends of each ink ejection region in the arrangement direction A (corresponding to an oblique side of the actuator unit 21), the above condition is satisfied by making a compensation relation to the ink ejection region corresponding to the opposite actuator unit 21 in the width of the ink-jet head 1. Therefore, in the ink-jet head 1 according to this embodiment, by ejecting ink droplets in order through a large number of ink ejection ports 8 arranged in the arrangement directions A and B with relative movement of a paper along the width of the ink-jet head 1, printing at 600 dpi in the main scanning direction can be performed.

Figure 8:
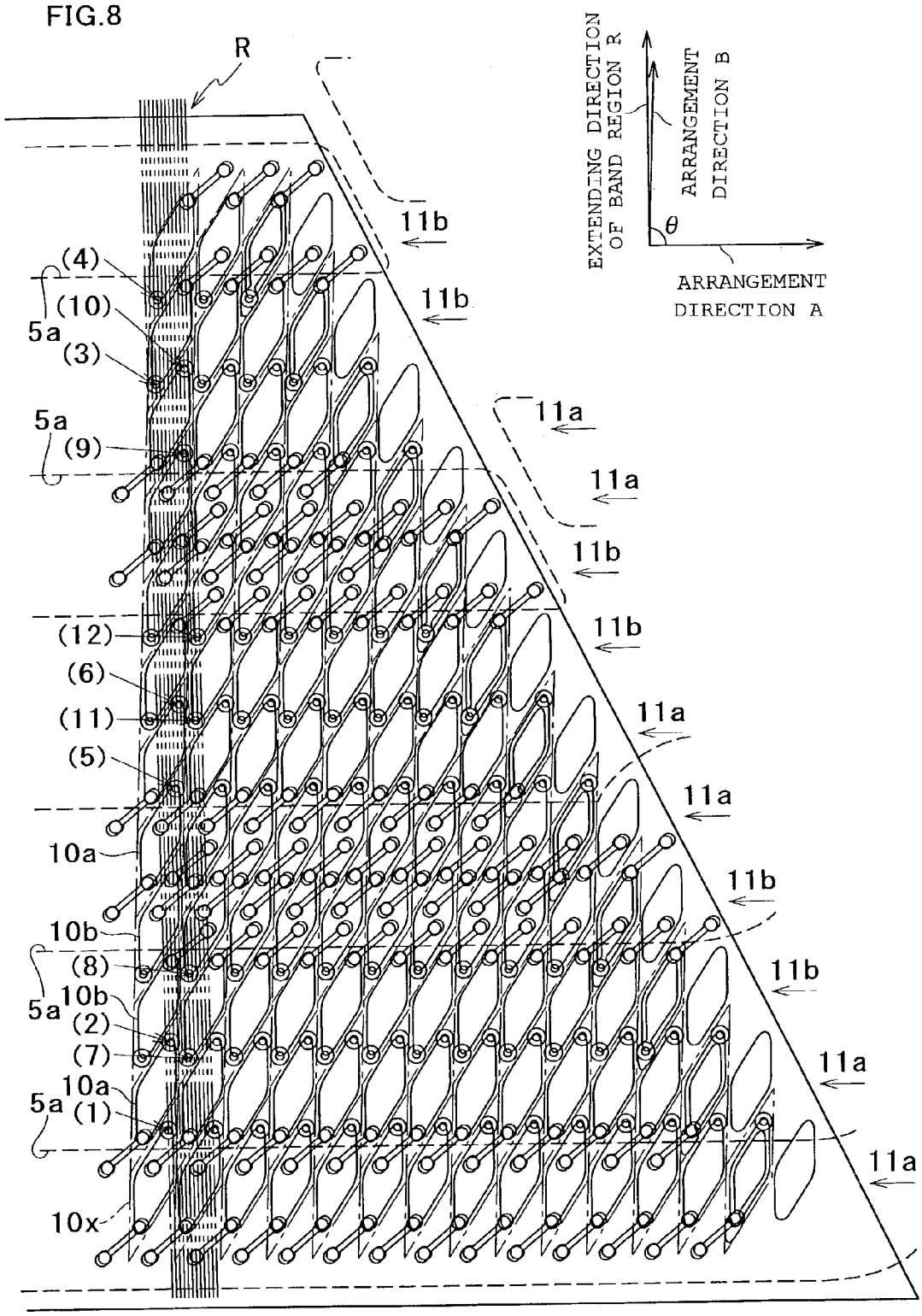
FIG. 8 is an enlarged view of the region enclosed with an alternate long and two short dashes line in FIG. 5.

Next, the construction of the passage unit 4 will be described in more detail with reference to FIG. 8. Referring to FIG. 8, pressure chambers 10 are arranged in lines in the arrangement direction A at predetermined intervals at 500 dpi. Twelve lines of pressure chambers 10 are arranged in the arrangement direction B. As the whole, the pressure chambers 10 are two-dimensionally arranged in the ink ejection region corresponding to one actuator unit 21.

The pressure chambers 10 are classified into two kinds, i.e., pressure chambers 10*a* in each of which a nozzle is connected with the upper acute portion in FIG. 8, and pressure chambers 10*b* in each of which a nozzle is connected with the lower acute portion. Pressure chambers 10*a* and 10*b* are arranged in the arrangement direction A to form pressure chamber rows 11*a* and 11*b*, respectively. Referring to FIG. 8, in the ink ejection region corresponding to one actuator unit 21, from the lower side of FIG. 8, there are disposed two pressure chamber rows 11*a* and two pressure chamber rows 11*b* neighboring the upper side of the pressure chamber rows 11*a*. The four pressure chamber rows of the two pressure chamber rows 11*a* and the two pressure chamber rows 11*b* constitute a set of pressure chamber rows. Such a set of pressure chamber rows is repeatedly disposed three times from the lower side in the ink ejection region corresponding to one actuator unit 21. A straight line extending through the upper acute portion of each pressure chamber in each pressure chamber rows 11*a* and 11*b* crosses the lower oblique side of each pressure chamber in the pressure chamber row neighboring the upper side of that pressure chamber row.

As described above, when viewing perpendicularly to FIG. 8, two first pressure chamber rows 11*a* and two pressure chamber rows 11*b*, in which nozzles connected with pressure chambers 10 are disposed at different positions, are arranged alternately to neighbor each other. Consequently, as the whole, the pressure chambers 10 are arranged regularly. On the other hand, nozzles are arranged in a concentrated manner in a central region of each set of pressure chamber rows constituted by the above four pressure chamber rows. Therefore, in case that each of the four pressure chamber rows constitute a set of pressure chamber rows and such a set of pressure chamber rows is repeatedly disposed three times from the lower side as described above, there is formed a region where no nozzle exists, in the vicinity of the boundary between each neighboring sets of pressure chamber rows, i.e., on both sides of each set of pressure chamber rows constituted by four pressure chamber rows. In this region where no nozzles exist, the sub-manifold channels 5*a* extend in order to supply ink to the corresponding pressure chambers 10. In this embodiment, in the ink ejection region corresponding to one actuator unit 21, four wide sub-manifold channels 5*a* in total are arranged in the arrangement direction A, i.e., one on the lower side of FIG. 8, one between the lowermost set of pressure chamber rows and the second lowermost set of pressure chamber rows, and two on both sides of the uppermost set of pressure chamber rows.

Referring to FIG. 8, nozzles communicating with ink ejection ports 8 for ejecting ink are arranged in the arrangement direction A at regular intervals at 50 dpi to correspond to the respective pressure chambers 10 regularly arranged in the arrangement direction A. On the other hand, while twelve pressure chambers 10 are regularly arranged also in the arrangement direction B forming an angle 'theta' with the arrangement direction A, twelve nozzles corresponding to the twelve pressure chambers 10 each communicate with the upper acute portion of the corresponding pressure chamber 10 and each communicate with the lower acute portion of the corresponding pressure chamber 10, as a result, they are not regularly arranged in the arrangement direction B at regular intervals.

If all nozzles communicate with the same-side acute portions of the respective pressure chambers 10, the nozzles are regularly arranged also in the arrangement direction B at regular intervals. In this case, nozzles are arranged so as to shift in the arrangement direction A by a distance corresponding to 600 dpi as resolution upon printing per pressure chamber row from the lower side to the upper side of FIG. 8. Contrastingly in this embodiment, since four pressure chamber rows of two pressure chamber rows 11*a* and two pressure chamber rows 11*b* constitute a set of pressure chamber rows and such a set of pressure chamber rows is repeatedly disposed three times from the lower side, the shift of nozzle position in the arrangement direction A per pressure chamber row from the lower side to the upper side of FIG. 8 is not always the same.

In the ink-jet head 1 according to this embodiment, a band region R will be discussed that has a width (about 508.0 μm) corresponding to 50 dpi in the arrangement direction A and extends perpendicularly to the arrangement direction A. In this band region R, any of twelve pressure chamber rows includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the arrangement direction A are distant from each other by a distance corresponding to 600 dpi as resolution upon printing.

When the twelve nozzles included in one band region R are denoted by (1) to (12) in order from one whose projected image onto a straight line extending in the arrangement direction A is the leftmost, the twelve nozzles are arranged in the order of (1), (7), (2), (8), (5), (11), (6), (12), (9), (3), (10), and (4) from the lower side.

In the thus-constructed ink-jet head 1 according to this embodiment, by properly driving active layers in the actuator unit 21, a character, a figure, or the like, having a resolution of 600 dpi can be formed. That is, by selectively driving active layers corresponding to the twelve pressure chamber rows in order in accordance with the transfer of a print medium, a specific character or figure can be printed on the print medium.

By way of example, a case will be described wherein a straight line extending in the arrangement direction A is printed at a resolution of 600 dpi. First, a case will be briefly described wherein nozzles communicate with the same-side acute portions of pressure chambers 10. In this case, in accordance with transfer of a print medium, ink ejection starts from a nozzle in the lowermost pressure chamber row in FIG. 8. Ink ejection is then shifted upward with selecting a nozzle belonging to the upper neighboring pressure chamber row in order. Ink dots are thereby formed in order in the arrangement direction A while neighboring each other at 600 dpi. Finally, all the ink dots form a straight line extending in the arrangement direction A at a resolution of 600 dpi.

On the other hand, in this embodiment, ink ejection starts from a nozzle in the lowermost pressure chamber row 11*a* in FIG. 8, and ink ejection is then shifted upward with selecting a nozzle communicating with the upper neighboring pressure chamber row in order in accordance with transfer of a print medium. In this embodiment, however, since the positional shift of nozzles in the arrangement direction A per pressure chamber row from the lower side to the upper side is not always the same, ink dots formed in order in the arrangement direction A in accordance with the transfer of the print medium are not arranged at regular intervals at 600 dpi.

More specifically, as shown in FIG. 8, in accordance with the transfer of the print medium, ink is first ejected through a nozzle (1) communicating with the lowermost pressure chamber row 11*a* in FIG. 8 to form a dot row on the print medium at intervals corresponding to 50 dpi (about 508.0 μm). After this, as the print medium is transferred and the straight line formation position has reached the position of a nozzle (7) communicating with the second lowermost pressure chamber row 11*a*, ink is ejected through the nozzle (7). The second ink dot is thereby formed at a position shifted from the first formed dot position in the arrangement direction A by a distance of six times the interval corresponding to 600 dpi (about 42.3 μm) (about 42.3 μm×6=about 254.0 μm).

Next, as the print medium is further transferred and the straight line formation position has reached the position of a nozzle (2) communicating with the third lowermost pressure chamber row 11*b*, ink is ejected through the nozzle (2). The third ink dot is thereby formed at a position shifted from the first formed dot position in the arrangement direction A by a distance of the interval corresponding to 600 dpi (about 42.3 μm). As the print medium is further transferred and the straight line formation position has reached the position of a nozzle (8) communicating with the fourth lowermost pressure chamber row 11*b*, ink is ejected through the nozzle (8). The fourth ink dot is thereby formed at a position shifted from the first formed dot position in the arrangement direction A by a distance of seven times the interval corresponding to 600 dpi (about 42.3 μm) (about 42.3 μm×7= about 296.3 μm). As the print medium is further transferred and the straight line formation position has reached the position of a nozzle (5) communicating with the fifth lowermost pressure chamber row 11*a*, ink is ejected through the nozzle (5). The fifth ink dot is thereby formed at a position shifted from the first formed dot position in the arrangement direction A by a distance of four times the interval corresponding to 600 dpi (about 42.3 μm) (about 42.3 μm×4=about 169.3 μm).

After this, in the same manner, ink dots are formed with selecting nozzles communicating with pressure chambers 10 in order from the lower side to the upper side in FIG. 8. In this case, when the number of a nozzle in FIG. 8 is N, an ink dot is formed at a position shifted from the first formed dot position in the arrangement direction A by a distance corresponding to (magnification n=N−1)×(interval corresponding to 600 dpi). When the twelve nozzles have been finally selected, the gap between the ink dots to be formed by the nozzles (1) in the lowermost pressure chamber rows 11*a* in FIG. 8 at an interval corresponding to 50 dpi (about 508.0 μm) is filled up with eleven dots formed at intervals corresponding to 600 dpi (about 42.3 μm). Therefore, as the whole, a straight line extending in the arrangement direction A can be drawn at a resolution of 600 dpi.

Figure 9:
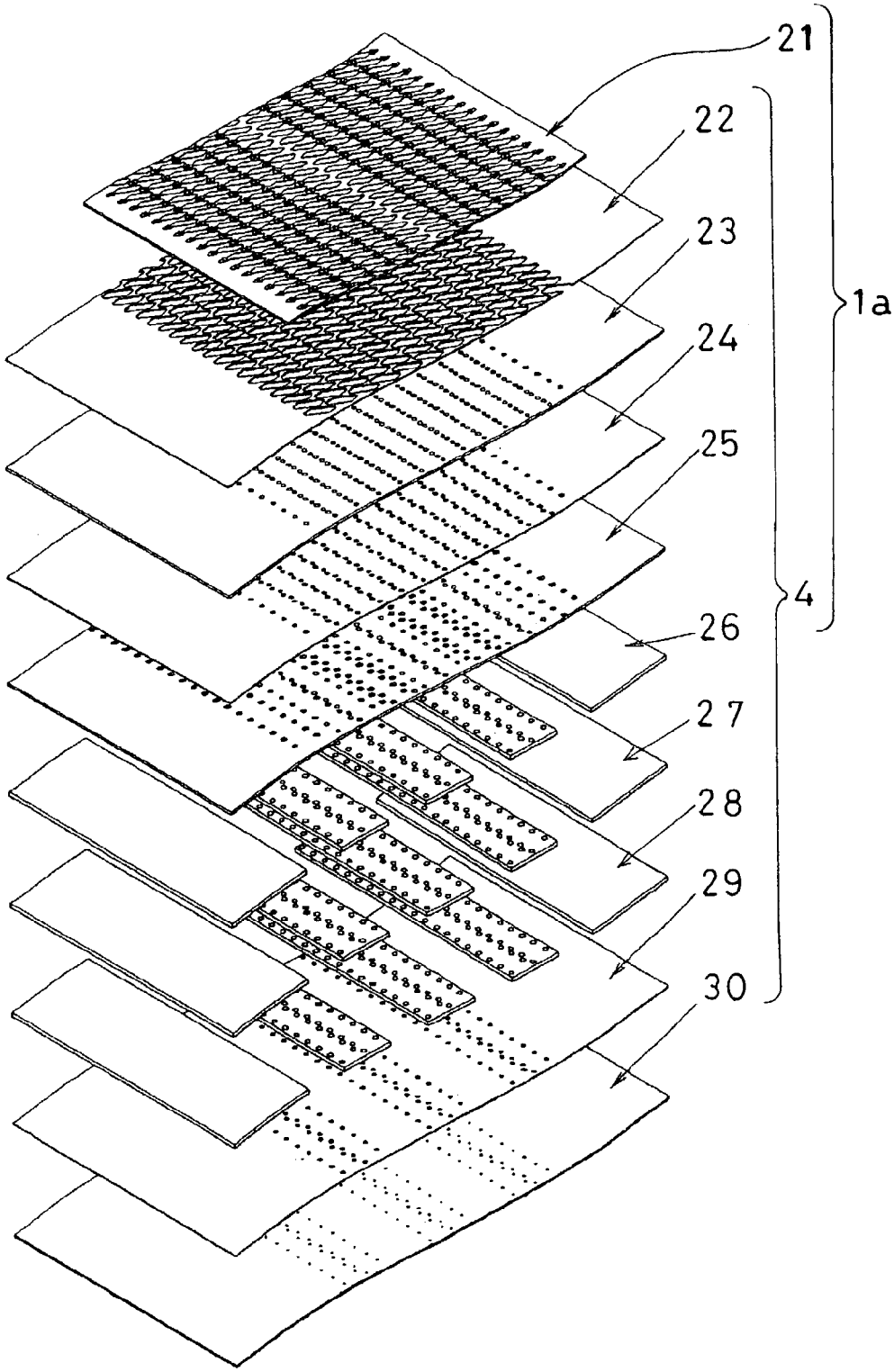
FIG. 9 is a partial exploded perspective view of the head main body of FIG. 4.

FIG. 9 is a partial exploded view of the head main body 1*a* of FIG. 4. Referring to FIGS. 7 and 9, a principal portion on the bottom side of the ink-jet head 1 has a layered structure laminated with ten sheet materials in total, i.e., from the top, an actuator unit 21, a cavity plate 22, a base plate 23, an aperture plate 24, a supply plate 25, manifold plates 26, 27, and 28, a cover plate 29, and a nozzle plate 30. Of them, nine plates other than the actuator unit 21 constitute the passage unit 4.

As will be described later in detail, the actuator unit 21 is laminated with five piezoelectric sheets and provided with electrodes so that three of them may include layers to be active when an electric field is applied (hereinafter, simply referred to as "layer including active layers") and the remaining two layers may be inactive. The cavity plate 22 is made of metal, in which a large number of substantially rhombic openings are formed corresponding to the respective pressure chambers 10. The base plate 23 is made of metal, in which a communication hole between each pressure chamber 10 of the cavity plate 22 and the corresponding aperture 12, and a communication hole between the pressure chamber 10 and the corresponding ink ejection port 8 are formed. The aperture plate 24 is made of metal, in which, in addition to apertures 12, communication holes are formed for connecting each pressure chamber 10 of the cavity plate 22 with the corresponding ink ejection port 8. The supply plate 25 is made of metal, in which communication holes between each aperture 12 and the corresponding sub-manifold channel 5*a* and communication holes for connecting each pressure chamber 10 of the cavity plate 22 with the corresponding ink ejection port 8 are formed. Each of the manifold plates 26, 27, and 28 is made of metal, which defines an upper portion of each sub-manifold channel 5*a* and in which communication holes are formed for connecting each pressure chamber 10 of the cavity plate 22 with the corresponding ink ejection port 8. The cover plate 29 is made of metal, in which communication holes are formed for connecting each pressure chamber 10 of the cavity plate 22 with the corresponding ink ejection port 8. The nozzle plate 30 is made of metal, in which tapered ink ejection ports 8 each functioning as a nozzle are formed for the respective pressure chambers 10 of the cavity plate 22.

These ten plates 21 to 30 are put in layers and are positioned with respect to each other to form such an ink passage 32 as illustrated in FIG. 7. The ink passage 32 first extends upward from the sub-manifold channel 5*a*, then extends horizontally in the aperture 12, then further extends upward, then again extends horizontally in the pressure chamber 10, then extends obliquely downward in a certain length to get apart from the aperture 12, and then extends vertically downward toward the ink ejection port 8.

Figure 10:
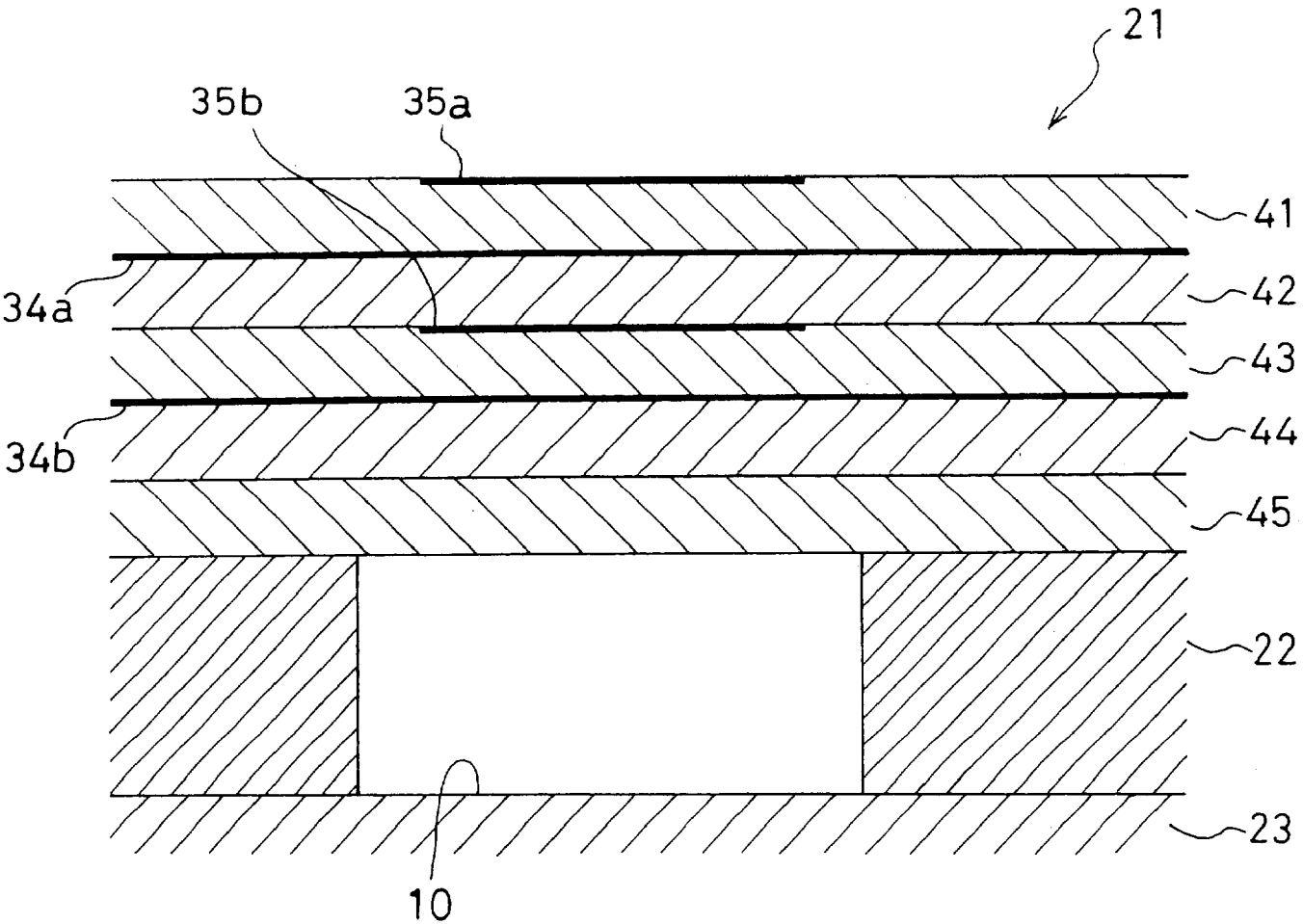
FIG. 10 is a lateral enlarged sectional view of the region enclosed with an alternate long and short dash line in FIG. 7.

Next, the construction of the actuator unit 21 will be described. FIG. 10 is a lateral enlarged sectional view of the region enclosed with an alternate long and short dash line in FIG. 7. Referring to FIG. 10, the actuator unit 21 includes five piezoelectric sheets 41, 42, 43, 44, and 45 having the same thickness of about 15 μm. These piezoelectric sheets 41 to 45 are made into a continuous layered flat plate (continuous flat layers) that is so disposed as to extend over many pressure chambers 10 formed within one ink ejection region in the ink-jet head 1. Since the piezoelectric sheets 41 to 45 are disposed so as to extend over many pressure chambers 10 as the continuous flat layers, the individual electrodes 35*a* and 35*b* can be arranged at a high density by using, e.g., a screen printing technique. Therefore, also the pressure chambers 10 formed at positions corresponding to the individual electrodes 35*a* and 35*b* can be arranged at a high density. This makes it possible to print a high-resolution image. In this embodiment, each of the piezoelectric sheets 41 to 45 is made of a lead zirconate titanate (PZT)-base ceramic material having ferroelectricity.

Between the uppermost piezoelectric sheet 41 of the actuator unit 21 and the piezoelectric sheet 42 neighboring downward the piezoelectric sheet 41, an about 2 μm-thick common electrode 34*a* is interposed. The common electrode 34*a* is made of a single conductive sheet extending substantially in the whole region of the actuator unit 21. Also, between the piezoelectric sheet 43 neighboring downward the piezoelectric sheet 42 and the piezoelectric sheet 44 neighboring downward the piezoelectric sheet 43, an about 2 μm-thick common electrode 34*b* is interposed having the same shape as the common electrode 34*a*.

In a modification, many pairs of common electrodes 34*a* and 34*b* each having a shape larger than that of a pressure chamber 10 so that the projection image of each common electrode projected along the thickness of the common electrode may include the pressure chamber, may be provided for each pressure chamber 10. In another modification, many pairs of common electrodes 34*a* and 34*b* each having a shape somewhat smaller than that of a pressure chamber 10 so that the projection image of each common electrode projected along the thickness of the common electrode may be included in the pressure chamber, may be provided for each pressure chamber 10. Thus, the common electrode 34*a* or 34*b* may not always be a single conductive sheet formed on the whole of the face of a piezoelectric sheet. In the above modifications, however, all the common electrodes must be electrically connected with one another so that the portion corresponding to any pressure chamber 10 may be at the same potential.

Referring to FIG. 10, an about 1 μm-thick individual electrode 35*a* is formed on the upper face of the piezoelectric sheet 41 at a position corresponding to the pressure chamber 10. The individual electrode 35*a* has a nearly rhombic shape (length: 850 μm, width: 250 μm) in a plan view similar to that of the pressure chamber 10, so that a projection image of the individual electrode 35*a* projected along the thickness of the individual electrode 35*a* is included in the corresponding pressure chamber 10 (see FIG. 6). Between the piezoelectric sheets 42 and 43, an about 2 μm-thick individual electrode 35*b* having the same shape as the individual electrode 35*a* in a plan view is interposed at a position corresponding to the individual electrode 35*a*. No electrode is provided between the piezoelectric sheet 44 and the piezoelectric sheet 45 neighboring downward the piezoelectric sheet 44, and on the lower face of the piezoelectric sheet 45. Each of the electrodes 34*a*, 34*b*, 35*a*, and 35*b* is made of, e.g., an Ag—Pd-base metallic material.

The common electrodes 34*a* and 34*b* are grounded in a not-illustrated region. Thus, the common electrodes 34*a* and 34*b* are kept at the ground potential at a region corresponding to any pressure chamber 10. The individual electrodes 35*a* and 35*b* in each pair corresponding to a pressure chamber 10 are connected to a driver IC 132 through an FPC 136 including leads independent of another pair of individual electrodes so that the potential of each pair of individual electrodes can be controlled independently of that of another pair (see FIGS. 2 and 3). In this case, the individual electrodes 35*a* and 35*b* in each pair vertically arranged may be connected to the driver IC 132 through the same lead.

In the ink-jet head 1 according to this embodiment, the piezoelectric sheets 41 to 43 are polarized in their thickness. Therefore, the individual electrodes 35*a* and 35*b* are set at a potential different from that of the common electrodes 34*a* and 34*b* to apply an electric field in the polarization, the portions of the piezoelectric sheets 41 to 43 to which the electric field has been applied works as active layers and the portions are ready to expand or contract in thickness, i.e., in layers, and to contract or expand perpendicularly to the thickness, i.e., in a plane, by the transversal piezoelectric effect. On the other hand, since the remaining two piezoelectric sheets 44 and 45 are inactive layers having no regions sandwiched by the individual electrodes 35*a* and 35*b* and the common electrodes 34*a* and 34*b*, they can not deform. That is, the actuator unit 21 has a so-called unimorph structure in which the upper (i.e., distant from the pressure chamber 10) three piezoelectric sheets 41 to 43 are layers including active layers and the lower (i.e., near the pressure chamber 10) two piezoelectric sheets 44 and 45 are inactive layers.

Therefore, when the driver IC 132 is controlled so that an electric field is produced in the same direction as the polarization and the individual electrodes 35*a* and 35*b* are set at a positive or negative predetermined potential relative to the common electrodes 34*a* and 34*b*, active layers in the piezoelectric sheets 41 to 43 sandwiched by the individual electrodes 35*a* and 35*b* and the common electrodes 34*a* and 34*b* contract in a plane, while the piezoelectric sheets 44 and 45 do not contract. At this time, as illustrated in FIG. 10, the lowermost face of the piezoelectric sheets 41 to 45 is fixed to the upper face of partitions partitioning pressure chambers 10 formed in the cavity plate 22, as a result, the piezoelectric sheets 41 to 45 deform into a convex shape toward the pressure chamber side by contracting in a plane by the transversal piezoelectric effect (unimorph deformation). Therefore, the volume of the pressure chamber 10 is decreased to raise the pressure of ink. The ink is thereby ejected through the ink ejection port 8. After this, when the individual electrodes 35*a* and 35*b* are returned to the original potential, the piezoelectric sheets 41 to 45 return to the original flat shape and the pressure chamber 10 also returns to its original volume. Thus, the pressure chamber 10 sucks ink therein through the manifold channel 5.

In another driving method, all the individual electrodes 35*a* and 35*b* are set in advance at a different potential from that of the common electrodes 34*a* and 34*b* so that the piezoelectric sheets 41 to 45 deform into a convex shape toward the pressure chamber 10 side. When an ejecting request is issued, the corresponding pair of individual electrodes 35*a* and 35*b* is once set at the same potential as that of the common electrodes 34*a* and 34*b*. After this, at a predetermined timing, the pair of individual electrodes 35*a* and 35*b* is again set at the different potential from that of the common electrodes 34*a* and 34*b*. In this case, at the timing when the pair of individual electrodes 35*a* and 35*b* is set at the same potential as that of the common electrodes 34*a* and 34*b*, the piezoelectric sheets 41 to 45 return to their original shapes. The corresponding pressure chamber 10 is thereby increased in volume from its initial state (the state that the potentials of both electrodes differ from each other), to suck ink from the manifold channel 5 into the pressure chamber 10. After this, at the timing when the pair of individual electrodes 35*a* and 35*b* is again set at the different potential from that of the common electrodes 34*a* and 34*b*, the piezoelectric sheets 41 to 45 deform into a convex shape toward the pressure chamber 10. The volume of the pressure chamber 10 is thereby decreased and the pressure of ink in the pressure chamber 10 increases to eject ink.

In case that the polarization occurs in the reverse direction to the electric field applied to the piezoelectric sheets 41 to 43, the active layers in the piezoelectric sheets 41 to 43 sandwiched by the individual electrodes 35*a* and 35*b* and the common electrodes 34*a* and 34*b* are ready to elongate perpendicularly to the polarization. As a result, the piezoelectric sheets 41 to 45 deform into a concave shape toward the pressure chamber 10 by the transversal piezoelectric effect. Therefore, the volume of the pressure chamber 10 is increased to suck ink from the manifold channel 5. After this, when the individual electrodes 35*a* and 35*b* return to their original potential, the piezoelectric sheets 41 to 45 also return to their original flat shape. The pressure chamber 10 thereby returns to its original volume to eject ink through the ink ejection port 8.

As described above, in the ink-jet head 1 of this embodiment, as illustrated in FIG. 6, when viewing perpendicularly to the surface of the passage unit 4 (third direction), the nozzle (the ink ejection port 8 at the tip end is illustrated in FIG. 6) connected with each pressure chamber 10 is not provided at the center of the pressure chamber 10 but deviated to one end. A sub-manifold channel 5*a* that functions as a common ink passage is disposed so as to include the boundary region between first and second pressure chamber rows 11*a* and 11*b* in which nozzles are deviated on the opposite sides with respect to the arrangement direction A. Thus, the width of the sub-manifold channel 5*a* can be made large. Therefore, even when the thickness (depth) of the sub-manifold channel 5*a* in the above third direction is fixed, the passage resistance of the sub-manifold channel 5*a* to ink is low, and so ink supply to the pressure chamber 10 can smoothly be performed.

In addition, as illustrated in FIG. 7, the passage unit 4 includes apertures 12 extending substantially in parallel with the surface of the passage unit 4. Each pressure chamber 10 is connected with the corresponding sub-manifold channel 5*a* through an aperture 12. Thus, the number of sub-manifold channels 5*a* can be reduced. For example, in case that each pressure chamber 10 is connected directly with the corresponding sub-manifold channel 5*a* and not through an aperture 12, the sub-manifold channel 5*a* must extend along each pressure chamber row 11*a* or 11*b* as illustrated in FIG. 6. However, as in this embodiment, by connecting each pressure chamber 10 with the corresponding sub-manifold channel 5*a* through an aperture 12, since ink supply is possible even if the pressure chamber 10 is somewhat distant from the sub-manifold channel 5*a* when viewing in the third direction perpendicular to the surface of the passage unit 4, the sub-manifold channel 5*a* need not be provided for each pressure chamber row 11*a* or 11*b*.

Further, as illustrated in FIG. 7, by providing the pressure chamber 10 and the aperture 12 at different levels perpendicularly to the surface of the passage unit 4 (third direction), the pressure chamber 10 can overlap the aperture 12 when viewing in the third direction. Thus, high integration of pressure chambers 10 is possible and high-resolution image formation can be realized with an ink-jet head 1 having a relatively small occupation area.

Further, as illustrated in FIG. 6, by alternately arranging first pressure chamber rows 11*a* and second pressure chamber rows 11*b* two by two, the number of sub-manifold channels 5*a* can be reduced in comparison with the case of the below-described modification. Besides, by disposing one sub-manifold channel 5*a* for each two pressure chamber rows 11*a* and 11*b* neighboring each other, since the width of the sub-manifold channel 5*a* can be made large, the passage resistance is lower and ink supply can be smoothly performed.

The advantage of increasing the width of each sub-manifold channel 5*a* with respect to the passage resistance will be explained in the following discussion. First, considering a sub-manifold channel in a rectangular section having a width a and a depth b, the passage resistance R to ink passing through the sub-manifold channel is given by the following expression (1):

$$R = 8 \cdot \mu \cdot l \cdot \frac{(a+b)^2}{(a \cdot b)^3} \tag{1}$$

where $\mu$: ink viscosity.

Next, in case that n sub-manifold channels each having a width of a/n (n: an integer of 2 or more) smaller than the width of the above-described sub-manifold channel are arranged in parallel so that the whole width is a, the passage resistance R' to ink passing through each sub-manifold channel is given by the following expression (2):

$$R' = 8 \cdot \mu \cdot l \cdot \frac{1}{n} \cdot \frac{\left(\frac{a}{n} + b\right)^2}{\left(\frac{a}{n} \cdot b\right)^3}. \tag{2}$$

The expressions (1) and (2) give the following expression (3):

$$\frac{R}{R'} = \frac{(a+b)^2}{(a+nb)^2}. \tag{3}$$

Since R/R'<1 from the expression (3), when the whole passage width is fixed, it is understood that the passage resistance in the case that a large number of sub-manifold channels each having a small width are provided is larger than that in the case that a small number of sub-manifold channels each having a large width are provided. Inversely, considering the fact that a sub-manifold channel having a large width gives a low passage resistance to ink so that it is easy to supply ink, in comparison with the case that a large number of sub-manifold channels each having a small width are provided for a predetermined number of pressure chambers and a predetermined length of pressure chamber row, in the case that a small number of sub-manifold channels each having a large width are provided, neither too much nor too less ink can be supplied even if the whole passage width is made small.

The width of each sub-manifold channel 5*a* can be determined within a range that neither too much nor too less ink can be supplied to each pressure chamber 10. In this embodiment, one sub-manifold channel 5*a* is disposed so as to extend near nozzles for each two pressure chamber rows 11*a* and 11*b* neighboring each other.

Besides, when viewing perpendicularly to the surface of the passage unit 4 (third direction), each sub-manifold channel 5*a* of this embodiment includes most parts of one first pressure chamber row 11*a* and one second pressure chamber row 11*b* neighboring each other so that the ink ejection ports 8 of the nozzles connected with the respective pressure chambers 10 face outward. Since the width of the sub-manifold channel 5*a* is thus increased within a range that the sub-manifold channel 5*a* does not overlap any nozzle and the ink ejection port 8 at the tip end of the nozzle, the passage resistance of the sub-manifold channel 5*a* can be lower in order to obtain a smooth ink supply.

In addition, since the pressure wave propagation direction in each pressure chamber 10 is substantially in parallel with the surface of the passage unit 4, ink ejection control utilizing AL is easy in comparison with a case wherein the propagation direction is perpendicular to the surface of the passage unit 4. In case of a short AL, ink is generally ejected by so-called "fill after fire". In case of a long AL as in this embodiment, however, utilizing reverse reflection of pressure wave, there is a margin in time for performing "fill before fire" (a method in which a voltage is applied in advance to all the individual electrodes 35*a* and 35*b* to decrease the volumes of all pressure chambers 10, the individual electrodes 35*a* and 35*b* of only a pressure chamber 10 to be used for ink ejection are relieved from the voltage to increase the volume of the pressure chamber 10, then a voltage is again applied to the individual electrodes 35*a* and 35*b* to decrease the volume of the pressure chamber 10, and thereby ejection pressure is efficiently applied to ink utilizing the pressure wave propagating in the pressure chamber 10), in which energy to be supplied is lower than that in "fill after fire". Thus, energy efficiency can be improved in comparison with the case that the pressure wave propagation direction is perpendicular to the surface of the pressure chamber 10.

Further, since the passage unit 4 is formed with nine sheet members 22 to 30 laminated with each other and each having corresponding openings, the manufacture of the passage unit 4 is easy.

Further, in the head main body 1*a* of the ink-jet head 1, separate actuator units 21 corresponding to the respective ink ejection regions are bonded onto the passage unit 4 to be arranged along the length of the passage unit 4. Therefore, each of the actuator units 21 apt to be uneven in dimensional accuracy because they are formed by sintering or the like, can be positioned to the passage unit 4 independently from another actuator unit 21. Thus, even in case of a long head, the increase in shift of each actuator unit 21 from the accurate position on the passage unit 4 is restricted, and both can accurately be positioned to each other. Therefore, as to even an individual electrodes 35*a* and 35*b* being relatively apart from a mark, the individual electrodes 35*a* and 35*b* can not be considerably shifted from the predetermined position to the corresponding pressure chamber 10. As a result, good ink ejection performance can be obtained and the manufacture yield of the ink-jet heads 1 is remarkably improved. On the other hand, differently from the above, if a long-shaped actuator unit 4 is made like the passage unit 4, the more the individual electrodes 35*a* and 35*b* are apart from the mark, the larger the shift of the individual electrodes 35*a* and 35*b* is from the predetermined position on the corresponding pressure chamber 10 in a plan view when the actuator unit 21 is laid over the passage unit 4. As a result, the ink ejection performance of a pressure chamber 10 relatively apart from the mark is deteriorated and thus the uniformity of the ink ejection performance in the ink-jet head 1 is not obtained.

Further, in the actuator unit 21, since the piezoelectric sheets 41 to 43 are sandwiched by the common electrodes 34*a* and 34*b* and the individual electrodes 35*a* and 35*b*, the volume of each pressure chamber 10 can easily be changed by the piezoelectric effect. Besides, since the piezoelectric sheets 41 to 45 are made into a continuous layered flat plate (continuous flat layers), the actuator unit 21 can easily be manufactured.

Further, the ink-jet head 1 has the actuator units 21 each having a unimorph structure in which the piezoelectric sheets 44 and 45 near each pressure chamber 10 are inactive and the piezoelectric sheets 41 to 43 distant from each pressure chamber 10 include active layers. Therefore, the change in volume of each pressure chamber 10 can be increased by the transversal piezoelectric effect. As a result, in comparison with an ink-jet head in which a layer including active portions is provided on the pressure chamber 10 side and a non-active layer is provided on the opposite side, lowering the voltage to be applied to the individual electrodes 35*a* and 35*b* and/or high integration of the pressure chambers 10 can be intended. By lowering the voltage to be applied, the driver for driving the individual electrodes 35*a* and 35*b* can be made small in size and the cost can be held down. In addition, each pressure chamber 10 can be made small in size. Besides, even in case of a high integration of the pressure chambers 10, a sufficient amount of ink can be ejected. Thus, a decrease in size of the head 1 and a highly dense arrangement of printing dots can be realized.

Further, in the head main body 1*a* of the ink-jet head 1, each actuator unit 21 has a substantially trapezoidal shape. The actuator units 21 are arranged in two lines in a staggered shape so that the parallel opposed sides of each actuator unit 21 extend along the length of the passage unit 4, and the oblique sides of each neighboring actuator units 21 overlap each other in the width of the passage unit 4. Since the oblique sides of each neighboring actuator units 21 thus overlap each other, in the length of the ink-jet head 1, the pressure chambers 10 existing along the width of the passage unit 4 can compensate each other. For example, using FIG. 5, a group of pressure chambers 10, which are included in the middle actuator unit 21, define a first pressure chamber group and a group of pressure chambers 10, which are included in the actuator unit 21 next to the middle actuator unit 21, i.e., in the upper actuator unit 21 in FIG. 5, define a second pressure chamber group. The first and second pressure chamber groups overlap each other with respect to a direction perpendicular to the extension direction of the sub-manifold channels 5*a*. As clearly shown in FIG. 5, the number of pressure chambers included in each pressure chamber row along the arrangement direction B (see FIG. 6, a slightly inclined direction from the transverse direction of FIG. 5) of each of the first and second pressure chamber groups in an overlapping portion is less than the number of pressure chambers included in each pressure chamber row along the arrangement direction B of each of the first and second pressure chamber groups in non-overlapping portion. The total number of pressure chambers included in a pressure chamber row along the arrangement direction B of the first pressure chamber group in the overlapping portion plus pressure chambers included in a pressure chamber row along the arrangement direction B of the second pressure chamber group which is opposed to the pressure chamber row of the first pressure chamber group with respect to the arrangement direction B is equal to the number of pressure chambers included in each pressure chamber row along the arrangement direction B of each of the first and second pressure chamber groups in the non-overlapping portion. As a result, with high-resolution printing, a small-size ink-jet head 1 having a very narrow width can be obtained.

Figure 11:
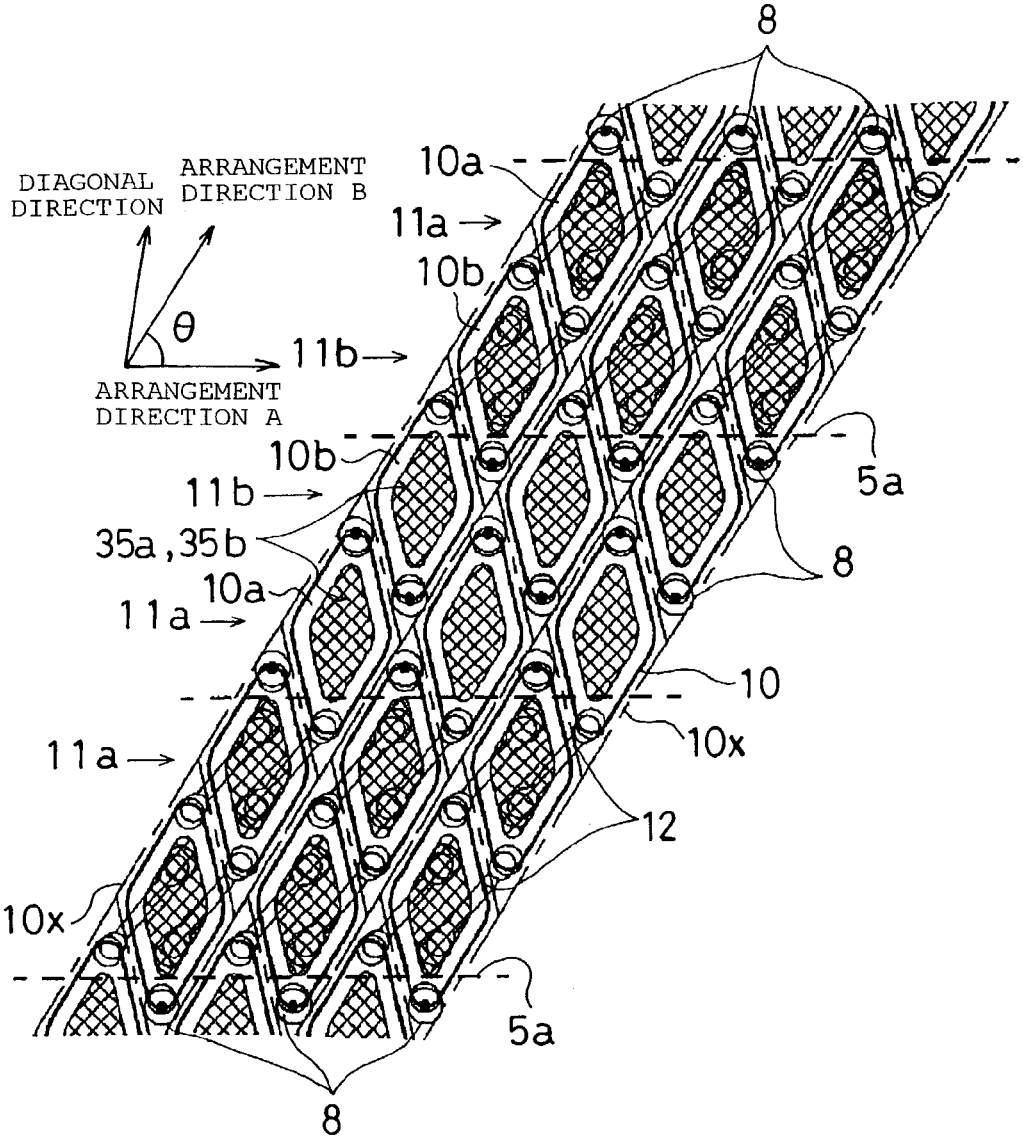
FIG. 11 is a schematic view of a modification of an arrangement of pressure chambers in a passage unit.

The arrangement directions of pressure chambers 10 disposed in a matrix along the surface of the passage unit 4 are not limited to the arrangement directions A and B described in the above embodiment as far as they are along the surface of the passage unit 4. The arrangement directions may be various. By way of example, FIG. 11 illustrates a modification of arrangement of pressure chambers 10 in the passage unit 4. The modification of FIG. 11 differs from the embodiment of FIG. 6 in the angle 'theta' between the arrangement directions A and B. The angle 'theta' of FIG. 11 is smaller than that of FIG. 6. The modification of FIG. 11 differs from the embodiment of FIG. 6 also in the relation between the arrangement directions A and B and a direction along the longer diagonal of each rhombic region 10×. In the modification of FIG. 11, the diagonal direction and the arrangement direction A form a larger angle than the arrangement directions A and B, differently from the embodiment of FIG. 6.

Figure 12:
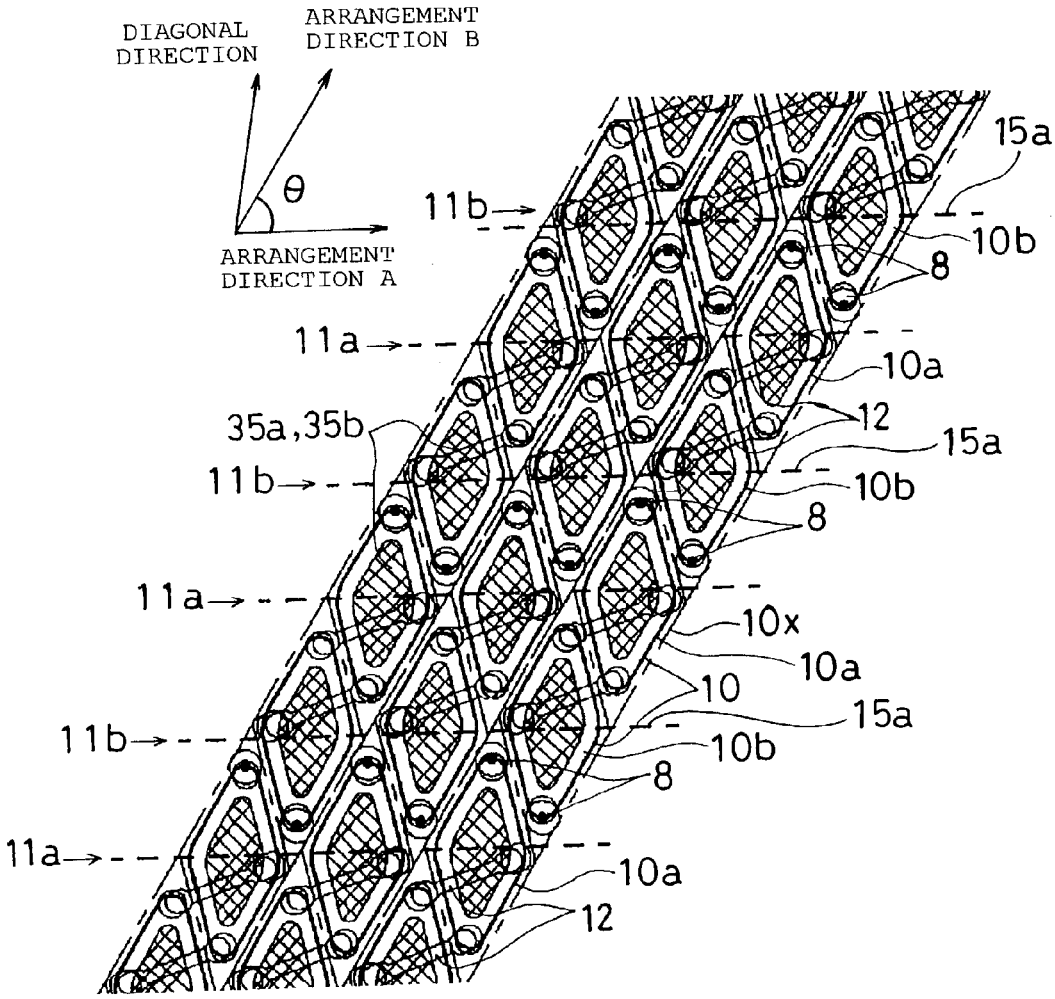
FIG. 12 is a schematic view of another modification of an arrangement of pressure chambers in the passage unit.

Further, FIG. 12 illustrates another modification of an arrangement of the pressure chambers 10 in the passage unit 4, wherein one first pressure chamber row 11*a* and one second pressure chamber row 11*b* are alternately repeated. In the region between each neighboring pressure chambers 10 in the arrangement direction A constituting each first pressure chamber row 11*a*, a pressure chamber 10 constituting a second pressure chamber row 11*b* protrudes from the upper side of FIG. 12. In this region, a pressure chamber 10 constituting another second pressure chamber row 11*b* protrudes from the lower side of FIG. 12. Also, in the region between each neighboring pressure chambers 10 in the arrangement direction A constituting each second pressure chamber row 11*a*, pressure chambers 10 constituting first pressure chamber rows 11*a* protrude from the upper and lower sides of FIG. 12, respectively. Thus, in comparison with the above-described embodiment of FIG. 6, the width of each sub-manifold channel 15*a* is small. However, the width of each sub-manifold channel 15*a* is large in comparison with a case wherein no increase occurs in an interval of ink ejection ports 8 for neighboring pressure chamber rows, such as a case wherein each pressure chamber row is constituted by pressure chambers 10 for each of which an ink ejection port 8 is deviated on one side along the longer diagonal of each rhombic region 10×, or a case wherein each pressure chamber row is constituted by pressure chambers 10 for each of which an ink ejection port 8 is disposed at the center of the pressure chamber 10. Therefore, the passage resistance of each sub-manifold channel 15*a* to ink is lowered and smooth ink supply to each pressure chamber 10 can be performed.

The region in which each pressure chamber 10 is included may not be rhombic but have another shape such as a parallelogram. Besides, the shape in a plan view of each pressure chamber 10 included in the region also may be changed into a proper shape such as a parallelogram. Further, each pressure chamber 10 may be slender along the pressure wave propagation direction though high integration of pressure chambers 10 can not be expected.

Besides, each pressure chamber 10 may communicate directly with the corresponding sub-manifold channel 5*a* and not through an aperture 12, though this is not preferable from the viewpoint of ink ejection stabilization. Further, apertures 12 may be provided at the same level as pressure chambers 10 in the third direction perpendicular to the surface of the passage unit 4. In this case, however, since each pressure chamber 10 can not overlap any aperture 12 when viewed perpendicularly to the surface of the passage unit 4 (third direction), high integration of pressure chambers 10 can not be intended.

Further, from the viewpoint of lowering the passage resistance, each sub-manifold channel 5*a* preferably includes the most parts of pressure chamber rows 11*a* and 11*b* neighboring each other. But, it suffices if each sub-manifold channel 5*a* includes a boundary region between those lines.

Further, the pressure wave propagation direction in each pressure chamber 10 may not be along a plane of the passage unit 4. Further, the passage unit 4 may not be formed with laminated sheet members.

Further, the material of each of the piezoelectric sheets and electrodes is not limited to those described above, and it may be changed to another known material. Each of the inactive layers may be made of an insulating sheet other than a piezoelectric sheet. The number of layers including active layers, the number of inactive layers, etc., may be changed properly. For example, although piezoelectric sheets as layers including active layers included in an actuator unit 21 are put in three or five layers in the above-described embodiment, piezoelectric sheets may be put in seven or more layers. In this case, the numbers of individual and common electrodes may properly be changed in accordance with the number of layered piezoelectric sheets. Although each actuator unit 21 includes two layers of piezoelectric sheets as inactive layers in the above-described embodiment, each actuator unit 21 may include only one inactive layer. Alternatively, each actuator unit 21 may include three or more inactive layers as far as they do not hinder the expansion or contraction deformation of the actuator unit 21. Although each actuator unit 21 of the above-described embodiment includes inactive layers on the pressure chamber side of layers including active layers, a layer or layers including active layers may be disposed on the pressure chamber 10 side of the inactive layers. Alternatively, no inactive layer may be provided. However, by providing the inactive layers 44 and 45 on the pressure chamber 10 side of the layers including active layers, it is expected to further improve the deformation efficiency of the actuator unit 21.

Further, although the common electrodes are kept at the ground potential in the above-described embodiment, this feature is not limitative. The common electrodes may be kept at any potential as far as the potential is in common to all pressure chambers 10.

Further, in the above-described embodiment, as illustrated in FIG. 4, trapezoidal actuator units 21 are arranged in two lines in a staggered shape. But, each actuator unit may not always be trapezoidal. Besides, actuator units may be arranged in a single line along the length of the passage unit. Alternatively, actuator units may be arranged in three or more lines in a staggered shape. Further, not one actuator unit 21 is disposed to extend over pressure chambers 10 but one actuator unit 21 may be provided for each pressure chamber 10.

Further, a large number of common electrodes 34*a* and 34*b* may be formed for each pressure chamber 10 so that a projection image of the common electrodes in the thickness of the common electrodes includes a pressure chamber region or the projection image is included within the pressure chamber region. Thus, each of the common electrodes 34*a* and 34*b* may not always be made of a single conductive sheet provided in the substantially whole region of each actuator unit 21. In such a case, however, the parts of each common electrode must be electrically connected with one another so that all the parts corresponding to the respective pressure chambers 10 are at the same potential.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head including a passage unit, comprising:

a plurality of pressure chambers each connected with a nozzle and arranged in a matrix in a plane to form a plurality of pressure chamber rows in a first direction in said plane; and a common ink passage extending along said first direction and communicating with said pressure chambers, said pressure chamber rows including a first pressure chamber row constituted by pressure chambers each connected with a nozzle deviated on one side thereof with respect to a second direction crossing said first direction, and a second pressure chamber row constituted by pressure chambers each connected with a nozzle deviated on another side thereof with respect to said second direction, when viewing from a third direction perpendicular to said plane, and said common ink passage overlapping the pressure chambers constituting said first and second pressure chamber rows with said nozzles non-overlapped with respect to said third direction so that the nozzles connected with the pressure chambers in each of the first and second pressure chamber rows face outward when viewing from said third direction, wherein said first and second pressure chamber rows are arranged adjacent to each other so that the pressure chambers constituting said first pressure chamber row and the pressure chambers constituting said second pressure chamber row partially overlap each other with respect to said first direction in a region corresponding to said common ink passage.

2. The ink-jet head according to claim 1, wherein said passage unit includes apertures each extending substantially in parallel with said plane, and said plurality of pressure chambers are connected with said common ink passage through one of said apertures.

3. The ink-jet head according to claim 2, wherein said apertures are provided at a different level from said plurality of pressure chambers with respect to said third direction.

4. The ink-jet head according to claim 2, wherein said pressure chamber rows further include a third pressure chamber row constituted by pressure chambers each connected with a nozzle deviated on the one side thereof with respect to said second direction, and a fourth pressure chamber row constituted by pressure chambers each connected with a nozzle deviated on the other side thereof with respect to said second direction, and said first, second, third, and fourth pressure chamber rows are alternately arranged with respect to a third direction.

5. The ink-jet head according to claim 1, wherein said common ink passage overlaps substantially whole area of each of the pressure chambers constituting said first and second pressure chamber rows with respect to said third direction.

6. The ink-jet head according to claim 1, wherein a line defined by connecting a portion communicating with the nozzle and a portion communicating with the common ink passage in a propagation direction of a pressure wave in each of said pressure chambers, wherein the line is substantially in parallel with said plane.

7. The ink-jet head according to claim 1, wherein said passage unit is formed with a plurality of sheet members laminated with each other.

8. An ink-jet printer including the ink-jet head according to claim 1.

9. An ink-jet head comprising:

a plurality of nozzles for ejecting ink;

a plurality of pressure chamber rows each constituted by a plurality of pressure chambers each having a substantially parallelogrammic shape in a plan view and arranged adjacent to each other, each of said pressure chambers connected with one of said nozzles; and first and second common ink passages disposed in parallel with each other so as to extend over said plurality of pressure chamber rows, said first and said second common ink passages communicating with said pressure chambers, wherein said pressure chamber row comprises:

a first pressure chamber communicating with said first common ink passage at one acute portion and with a first nozzle at an other acute portion;

a second pressure chamber neighboring said first pressure chamber on the side of said other acute portion communicating with said first nozzle, said second pressure chamber communicating with said first common ink passage at one acute portion facing said first pressure chamber and with a second nozzle at an other acute portion;

a third pressure chamber neighboring said second pressure chamber on the side of said other acute portion communicating with said second nozzle, said third pressure chamber communicating with a third nozzle at one acute portion facing said second pressure chamber and with said second common ink passage at an other acute portion; and a fourth pressure chamber neighboring said third pressure chamber on the side of said other acute portion communicating with said second common ink passage, said fourth pressure chamber communicating with a fourth nozzle at one acute portion facing said third pressure chamber and with said second common ink passage at an other acute portion, and wherein said first, second, third, and fourth nozzles being are disposed between said first and second common ink passages in a plane where said plurality of pressure chamber rows are formed.

10. The ink-jet head according to claim 9, wherein an arrangement direction of said pressure chamber rows forms an acute angle with an extension direction of said first and second common ink passages, and neighboring projected lines of nozzles onto a straight line along said extension direction of said first and second common ink passages are at a predetermined interval.

11. The ink-jet head according to claim 10, wherein said head comprises first and second pressure chamber groups each including a plurality of pressure chamber rows and disposed at an interval so as to overlap each other with respect to a direction perpendicular to said extension direction of said first and said second common ink passages, and the number of pressure chambers included in each pressure chamber of each of said first and second pressure chamber groups in an overlapping portion is less than the number of pressure chambers included in each pressure chamber row of each of said first and second pressure chamber groups in a non-overlapping portion, and the total number of pressure chambers included in a pressure chamber row of said first pressure chamber group in said overlapping portion plus pressure chambers included in a pressure chamber row of said second pressure chamber group which is opposed to the pressure chamber row of said first pressure chamber group with respect to said arrangement direction is equal to the number of pressure chambers included in each pressure chamber row of each of said first and second pressure chamber groups in said non-overlapping portion.

12. An ink-jet head comprising:

a plurality of nozzles for ejecting ink;

a plurality of pressure chamber rows each constituted by a plurality of pressure chambers each having a substantially parallelogrammic shape in a plan view and arranged adjacent to each other, each of said pressure chambers connected with one of said nozzles; and a first common ink passage disposed so as to extend over said plurality of pressure chamber rows, said first common ink passages communicating with said pressure chambers, said pressure chamber row comprising:

a first pressure chamber communicating with said first common ink passage at one acute portion and with a first nozzle at an other acute portion; and a second pressure chamber neighboring said first pressure chamber on the side of said one acute portion communicating with said first common ink passage, said second pressure chamber communicating with said first common ink passage at one acute portion facing said first pressure chamber and with a second nozzle at an other acute portion, wherein said first common ink passage is disposed between said first and second nozzles in a plane where said plurality of pressure chamber rows are formed so as to overlap said first and second pressure chambers with said nozzles non-overlapped with respect to a direction perpendicular to the plane, and said first and second pressure chambers in said pressure chamber row partially overlap each other with respect to an extension direction of said first common ink passage in a region corresponding to said first common ink passage.

13. The ink-jet head according to claim 12, wherein an arrangement direction of said pressure chamber rows forms an acute angle with said extension direction of said first common ink passages, and neighboring projected lines of nozzles onto a straight line along said extension direction of said first common ink passages are at a predetermined interval.

14. The ink-jet head according to claim 12, wherein said head further comprises a second common ink passage extending in parallel with said first common ink passage, and said pressure chamber rows further comprises:

a third pressure chamber neighboring said second pressure chamber on the side of said other acute portion communicating with said second nozzle, said third pressure chamber communicating with said first common ink passage at one acute portion facing said second pressure chamber and with a third nozzle at an other acute portion; and a fourth pressure chamber neighboring said third pressure chamber on the side of said other acute portion communicating with said third nozzle, said fourth pressure chamber communicating with a fourth nozzle at one acute portion facing said third pressure chamber and with the second common ink passage at an other acute portion.

15. The ink-jet head according to claim 14, wherein an arrangement direction of said pressure chamber rows forms an acute angle with an extension direction of said first and second common ink passages, and neighboring projected lines of nozzles onto a straight line along said extension direction of said first and second common ink passages are at a predetermined interval.

16. An ink-jet head, comprising:

a plurality of nozzles for ejecting ink;

a plurality of common ink passages extending in parallel with each other;

a plurality of pressure chambers each having a substantially parallelogrammic shape with corners rounded in a plan view, each of said pressure chambers having one end communicating with one of said nozzles and an other end communicating with one of said common ink passages;

a plurality of parallelogrammic regions each having a substantially similar shape in a plan view to that of said pressure chambers and including one of said pressure chambers, said parallelogrammic regions being arranged two-dimensionally; and an actuator unit for generating pressure in said pressure chambers so that ink supplied through one of said common ink passages is ejected through one of said nozzles, wherein said plurality of parallelogrammic regions comprises a first parallelogrammic region having a first nozzle at one acute portion, a second parallelogrammic region neighboring said first parallelogrammic region on the first nozzle side and having a second nozzle at an acute portion on the opposite of the side facing said first parallelogrammic region, a third parallelogrammic region neighboring said second parallelogrammic region on the second nozzle side and having a third nozzle at an acute portion on the side facing said second parallelogrammic region, and a fourth parallelogrammic region neighboring said third parallelogrammic region on the side opposite to the third nozzle and having a fourth nozzle at an acute portion on the side facing said third parallelogrammic region, wherein said first, second, third, and fourth parallelogrammic regions are arranged neighboring each other in a direction at an acute angle with an extension direction of said common ink passages so as to share one of its hypotenuses with each other, and each of said common ink passages are disposed close to at least one of said first and fourth nozzles.

17. The ink-jet head according to claim 16, wherein projected lines of said first, second, third, and fourth nozzles onto a straight line along said extension direction of said common ink passages do not overlap each other, and the projected lines of said first and third nozzles are at the same interval as the projected lines of said second and fourth nozzles.

18. The ink-jet head according to claim 16, wherein one or more parallelogrammic region groups are in a band region, said band region having a predetermined width in said extension direction of said common ink passages and extending along a direction perpendicular to said extension direction of said common ink passages, and neighboring projected lines of nozzles belonging to each of said parallelogrammic region groups onto a straight line along said extension direction of said common ink passages are at an interval corresponding to a resolution upon printing.

* * * * *